US010718126B2

(12) United States Patent
Hanan et al.

(10) Patent No.: US 10,718,126 B2
(45) Date of Patent: Jul. 21, 2020

(54) SELF-PROPELLED ROBOTIC SWIMMING POOL CLEANER WITH RETRACTABLY TETHERED FLOATING BUOY

(71) Applicant: AQUA PRODUCTS, INC, Cedar Grove, NJ (US)

(72) Inventors: Ethan Hanan, Teaneck, NJ (US); Kameshwar Durvasula, Garfield, NJ (US)

(73) Assignee: AQUA PRODUCTS, INC., Cedar Grove, NJ (US)

( * ) Notice: Subject to any disclaimer, the term of this patent is extended or adjusted under 35 U.S.C. 154(b) by 0 days.

(21) Appl. No.: 15/617,470

(22) Filed: Jun. 8, 2017

(65) Prior Publication Data

US 2017/0356212 A1 Dec. 14, 2017

Related U.S. Application Data

(60) Provisional application No. 62/349,791, filed on Jun. 14, 2016.

(51) Int. Cl.
*E04H 4/16* (2006.01)
*B63B 22/00* (2006.01)

(52) U.S. Cl.
CPC ..... *E04H 4/1654* (2013.01); *B63B 22/00* (2013.01)

(58) Field of Classification Search
None
See application file for complete search history.

(56) References Cited

U.S. PATENT DOCUMENTS

| | | | |
|---|---|---|---|
| 8,434,182 | B2 | 5/2013 | Horvath et al. |
| 9,487,281 | B2 | 11/2016 | Wolfenbarger |
| 10,209,719 | B2 | 2/2019 | Hadari et al. |

(Continued)

FOREIGN PATENT DOCUMENTS

| | | | |
|---|---|---|---|
| CN | 101725263 | A | 6/2010 |
| EP | 1122382 | B1 | 9/2004 |
| EP | 3258034 | | 6/2019 |

OTHER PUBLICATIONS

EPO machine translation for CN101725263 retrieved from https://worldwide.espacenet.com/publicationDetails/biblio?II=1&ND=3&adjacent=true&locale=en_EP&FT=D&date=20100609&CC=CN&NR=101725263A&Kc=A on Dec. 16, 2018 (Year: 2010).*

(Continued)

*Primary Examiner* — Eric W Golightly
(74) *Attorney, Agent, or Firm* — Kilpatrick Townsend & Stockton LLP; Dean W. Russell

(57) ABSTRACT

A method and apparatus for raising a self-propelled pool cleaner from a surface of a pool. The cleaner includes an interior chamber, a lower portion with an inlet and an upper portion with an outlet. Rotatably-mounted supports guide the cleaner along the pool surface. An interior water pump draws water/debris through the inlet, the debris is filtered in the interior chamber, and filtered water exits through the outlet to propel the cleaner during a cleaning operation. A buoy assembly is tethered to the cleaner via a retractable cable. When the cleaner is submerged, the cable is released and the buoy assembly floats on the water surface while tethered to the submerged cleaner. The cleaner can receive a command signal from a controller to exit from the pool, and the cable is retracted to cause the cleaner to rise from the submerged surface of the pool.

16 Claims, 23 Drawing Sheets

(56) References Cited

U.S. PATENT DOCUMENTS

| | | | | |
|---|---|---|---|---|
| 2004/0092181 | A1 | 5/2004 | Porat | |
| 2006/0156497 | A1* | 7/2006 | Burkholder | E04H 4/1627 15/29 |
| 2009/0165200 | A1* | 7/2009 | Kanetis | E04H 4/084 4/498 |
| 2010/0212574 | A1* | 8/2010 | Hawkes | B63C 11/42 114/328 |
| 2013/0104321 | A1 | 5/2013 | Michelon | |
| 2017/0057760 | A1 | 3/2017 | Maggeni et al. | |

OTHER PUBLICATIONS

Extended European Search Report for corresponding EP Appl. No. 17175712.3-1614 by The European Patent Office, dated Nov. 2, 2017.

European Application No. EP17175712.3, Notice of Decision to Grant dated May 16, 2019, 2 pages.

* cited by examiner

SELF-PROPELLED ROBOTIC SWIMMING POOL CLEANER WITH RETRACTABLY TETHERED FLOATING BUOY

CROSS-REFERENCE TO RELATED APPLICATION

This application claims the benefit of U.S. provisional application No. 62/349,791, filed on 14 Jun. 2016, the content of which is incorporated by reference herein in its entirety.

FIELD OF INVENTION

The invention relates to a self-propelled robotic pool cleaner, and more specifically, to a method and apparatus for raising the pool cleaner for removal from a swimming pool.

BACKGROUND OF INVENTION

Self-propelled robotic pool cleaners include one or more drive motors to move or otherwise propel the cleaner over a surface of a pool being cleaned. Electric power to the cleaner can be provided by an external power supply via a power cable, which is typically fabricated from two wire conductors having sufficient length to enable the cleaner to move over the bottom and side surfaces of the pool. Alternatively, electric power for the cleaner can be provided by an on-board battery or battery pack. The power supply provides electrical power to drive one or more electric motors that propel the cleaner over the pool surfaces. For example, the one or more motors can rotate the wheels, roller brushes, and/or tracks directly or via a gear/belt drive assembly. Alternatively, a pump motor having one or more propellers can be used to discharge a pressurized stream of filtered water in the form of a water jet that also propels the cleaner in a direction opposite the water jet. The incoming power from the power cable can also be directed to an on-board controller that includes a microcontroller, logic circuitry and/or programs to control the movement of the cleaner. The movement of the cleaner can be random, but is preferably in accordance with a predetermined cleaning pattern.

The robotic pool cleaner includes one or more inlets formed at the bottom or base of the cleaner housing through which water and debris are drawn into the housing interior for filtering. The debris is retained by the filter and the filtered water is then discharged from the cleaner back into the pool.

Removal of the cleaner from the pool is often necessary or desirable in various circumstances, for example, once the pool has been cleaned, the on-board battery power is low, the filter is full or any other condition that necessitates the cleaner to be removed from the pool. The user typically removes the cleaner manually from the swimming pool by lifting the cleaner out and placing it on a pool deck or a cart brought near the edge of the pool. Where the cleaner is powered by an external supply via a power cable, the power cable is often pulled or otherwise "reeled in" by a user from the edge of the pool until the cleaner can be grasped by hand and manually lifted out of the pool. For robotic pool cleaners that are powered by an internal battery, the user must "hope" that the cleaner still has enough power to reach and climb the sidewall of the pool for removal while the user is present, and if not, must physically enter the swimming pool to retrieve the cleaner.

As some individuals find that manually removing the pool cleaner from the pool can be time consuming and physically demanding, it would be advantageous to provide a robotic pool cleaner that can better lift and rise up from the bottom surface of a pool in a controlled manner for retrieval by an end user along the deck of the swimming pool.

SUMMARY OF THE INVENTION

In the description that follows, it will be understood that the pool cleaner moves on wheels, rollers or tracks that are aligned with the longitudinal axis of the cleaner body when it moves in a straight line. Reference to the front or forward end of the cleaner will be relative to its then-direction of movement. In one embodiment, an apparatus for cleaning a surface of a pool comprises: a robotic pool cleaner having a housing including an upper portion disposed over a lower portion to define an interior chamber therein, the lower portion including a water inlet and the upper portion having a water discharge port; rotatably-mounted supports supporting and guiding the cleaner along the pool surface; a filter assembly for filtering water drawn through the water inlet; a water pump assembly drawing water and debris from beneath the cleaner through the at least one inlet, the debris being retained by the filter assembly and the filtered water being discharged through the water discharge port during a cleaning operation; and a buoy assembly tethered to the cleaner via a retractable cable.

In an embodiment, the apparatus further comprises a spool and a spool rotation mechanism to release and retract the cable. In one aspect, the spool and spool rotation mechanism are housed in the buoy assembly. Alternatively, the spool and spool rotation mechanism are housed on-board the cleaner. In one aspect, the spool rotation mechanism includes a spring. In another aspect, the spool rotation mechanism includes an electric motor.

In yet another embodiment, the spool is configured to adjust a length of the cable as the buoy assembly floats on the pool water surface while the cleaner traverses at different depths of the pool. In still another aspect, the buoy assembly has a buoyancy sufficient to overcome a negative buoyancy of the cleaner and assist in lifting and raising the cleaner off a bottom surface of the pool by retracting the cable. In one aspect, the buoy assembly includes a first locking mechanism to lock the spool and maintain a constant length of cable being extended. In another aspect, the first locking mechanism comprises a latch and strike member arrangement. In still another embodiment, the apparatus further comprises a second locking mechanism for securing the buoy assembly to the upper portion of the cleaner. In one aspect, the second locking mechanism includes magnets. In another aspect, the buoy assembly includes a handle.

In an embodiment, the buoy assembly includes an antenna and the cable includes an electrical conductor for carrying received wireless signals from a remote controller to control circuitry in the cleaner. In one aspect, the buoy assembly includes a receiver electrically coupled to the antenna and cable. In another aspect, the cleaner includes a transceiver electrically coupled to the antenna via the cable.

In still another embodiment, a method for raising a self-propelled robotic pool cleaner from a surface of a pool, the pool cleaner comprising a housing including an upper portion disposed over a lower portion to define an interior chamber therein, the lower portion including a water inlet and the upper portion having a water discharge port; rotatably-mounted supports supporting and guiding the cleaner along the pool surface; a filter assembly for filtering water drawn through the water inlet; a water pump assembly for drawing water and debris from beneath the cleaner through the at least one inlet, the debris being retained by the filter assembly and the filtered water being discharged through the water discharge port during a cleaning operation; and a buoy assembly tethered to the cleaner via a retractable cable, the method comprises the steps of: submerging the pool cleaner to clean a surface of the pool; releasing the cable so that the buoy assembly is floating on the top surface of the water while tethered to the cleaner; receiving a command signal from a controller to remove the cleaner from the pool; and retracting the cable to cause the cleaner to rise from the submerged surface of the pool.

In one aspect, the step of receiving a command signal comprises receiving the command signal from a remote controller in response to a predetermined condition being satisfied. In another aspect, the method further comprises the step of moving the cleaner to a sidewall of the pool after receiving the command signal. In still another aspect, the method further comprises the step of climbing a sidewall of the pool after receiving the command signal. In yet another aspect, the method further comprises the step of securing the buoy assembly to the cleaner after retracting the cable. In another aspect, the step of receiving the command signal comprises receiving the command signal by an electronic receiver housed in one of the buoy assembly or on-board the cleaner; and forwarding the command signal to an on-board controller.

Figure 1:
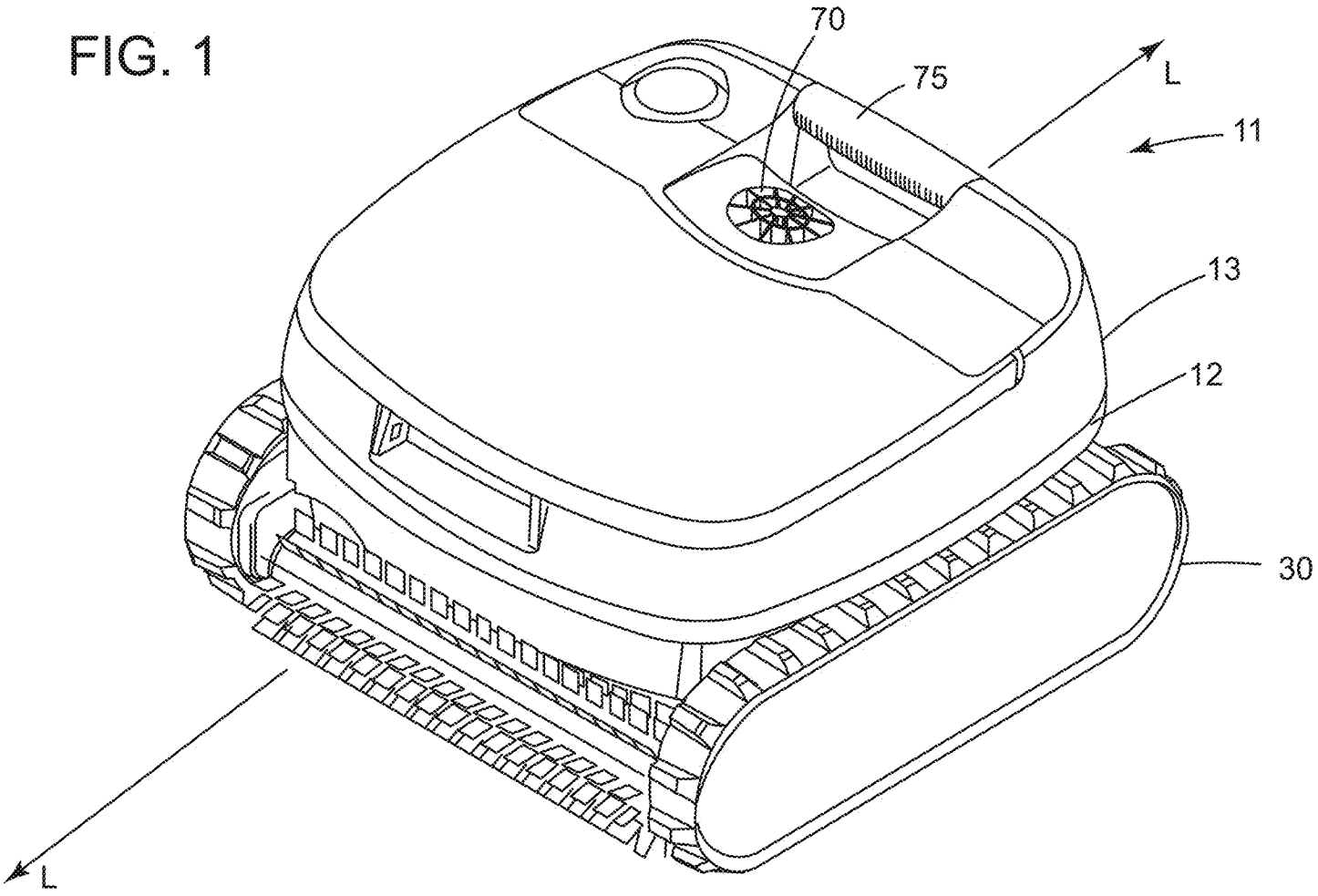
FIG. 1 is a top, front right side perspective view of a self-propelled robotic pool cleaner having an on-board electric motor and a water pump assembly suitable for the present invention.

In the following description of the invention, identical reference numerals have been used, when appropriate, to designate the same or similar elements that are common to the figures. Further, unless specifically stated otherwise, the features shown in the figures are not drawn to scale, but are shown for illustrative purposes only.

DETAILED DESCRIPTION OF THE INVENTION

For purposes of the following description of the invention, terms connoting direction and positioning of components are defined as follows: the longitudinal axis "L" of the cleaner is defined as extending centrally through the cleaner in the direction of movement; movement of the cleaner in a forward direction is the direction that the cleaner is presently being propelled or driven along its cleaning path; movement of the cleaner in a reverse direction is a direction that is opposite to the forward direction along the cleaning path; the front of the cleaner is defined as the portion of the cleaner that is generally perpendicular to the longitudinal axis as the cleaner travels in the forward direction of movement along its cleaning path; the "back" or "rear" of the cleaner is defined as the portion of the cleaner that is generally perpendicular to the longitudinal axis and opposite the forward direction of movement as the cleaner travels along its cleaning path. The front and rear portions of the cleaner are reversed as the cleaner is propelled in opposite directions; and the terms "top", "bottom", "upper" and "lower" are adjectives that denote different cleaner components, as well as define the relative positioning of such components with respect to a vertical plane extending centrally through the housing cover and base of the cleaner.

In one aspect, the invention is directed to a method, apparatus and system for raising a self-propelled robotic pool cleaner from the bottom surface of the pool, and more specifically to controlling the flow of one or more pressurized streams of water (i.e., water jets) that are directed towards the bottom surface of the pool beneath the cleaner. The pressurized water expelled from the bottom of the cleaner lifts the cleaner off the bottom surface of the pool and continues to raise the cleaner to the waterline, from which it can be manually removed (e.g., by hand, extension pole and the like) from the swimming pool by an end user. The lifting and removal of the cleaner does not cause the release of dirt and debris that was previously captured by a filter of the cleaner during cleaning operations.

Figure 2:
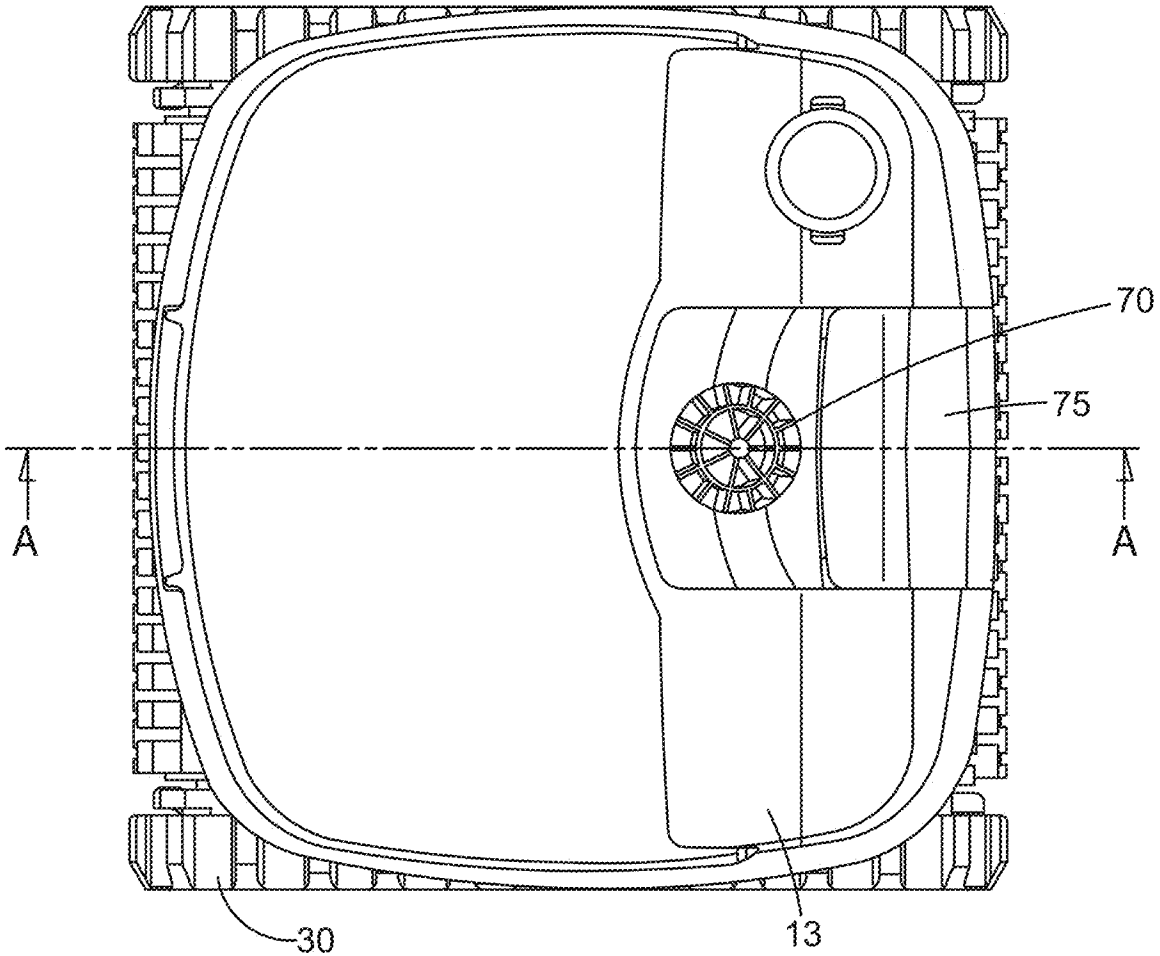
FIG. 2 is a top plan view of the pool cleaner of FIG. 1.
Figure 3:
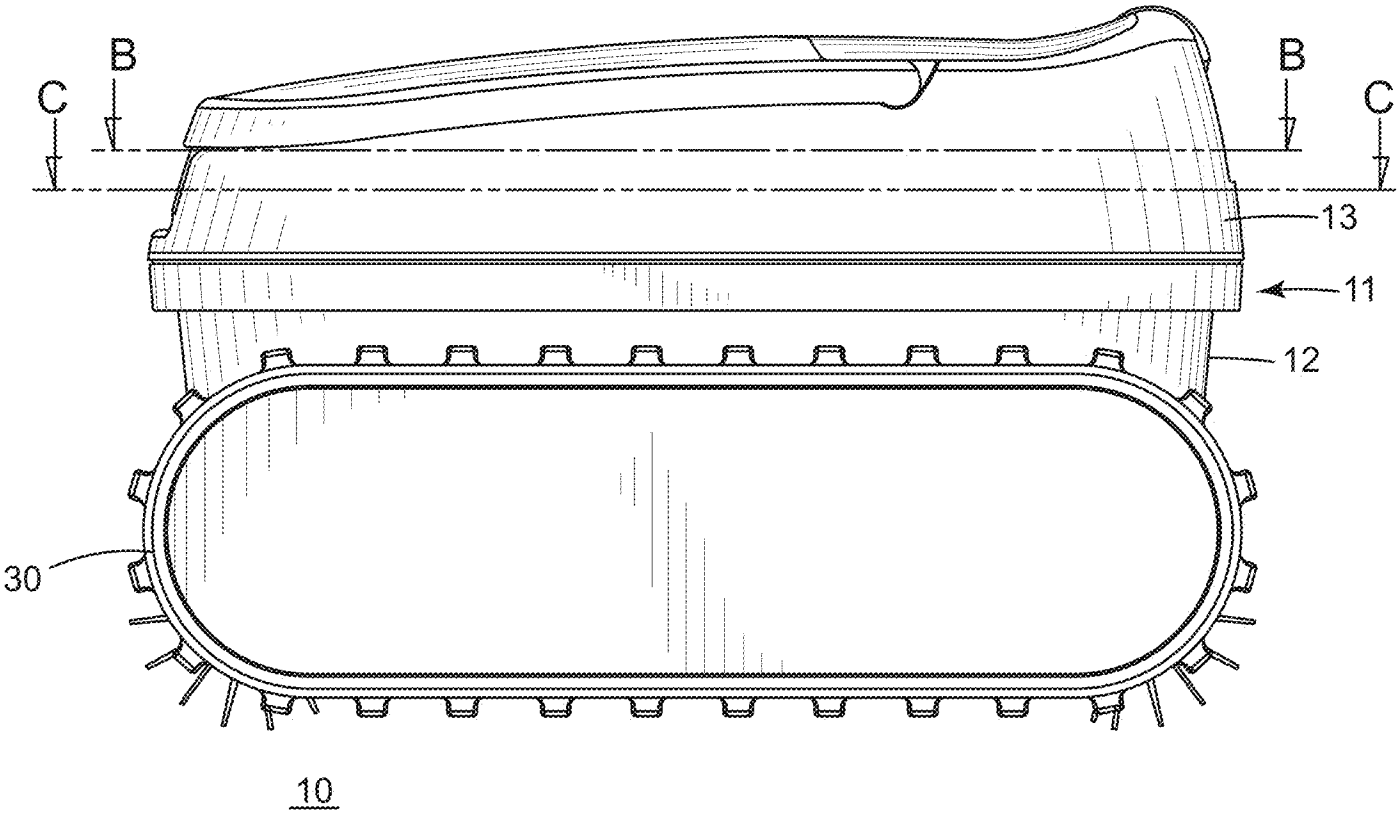
FIG. 3 is a right-side elevated view of the cleaner of FIG. 1.

Referring to FIGS. 1-3, an illustrative self-propelled robotic pool cleaner 10 is shown that is capable of expelling or discharging a high-pressure stream of water in the form of one or more jet streams from the beneath the cleaner to thereby lift the submerged cleaner off the bottom surface of the pool and raise it to the water surface or waterline of the pool water. In a first embodiment, the cleaner 10 of FIGS. 1-3 is lifted and raised to the waterline by a jet stream flowing through a lower discharge opening or conduit formed on the bottom or base of the cleaner 10, as illustratively shown and described with respect to FIGS. 4-7. Alternatively, the cleaner 10 of FIGS. 1-3 is lifted and raised to the waterline by one or more high-pressure jet streams expelled from nozzles provided on the bottom or base of the cleaner 10, as illustratively shown and described with respect to FIGS. 8-14.

Figure 4:
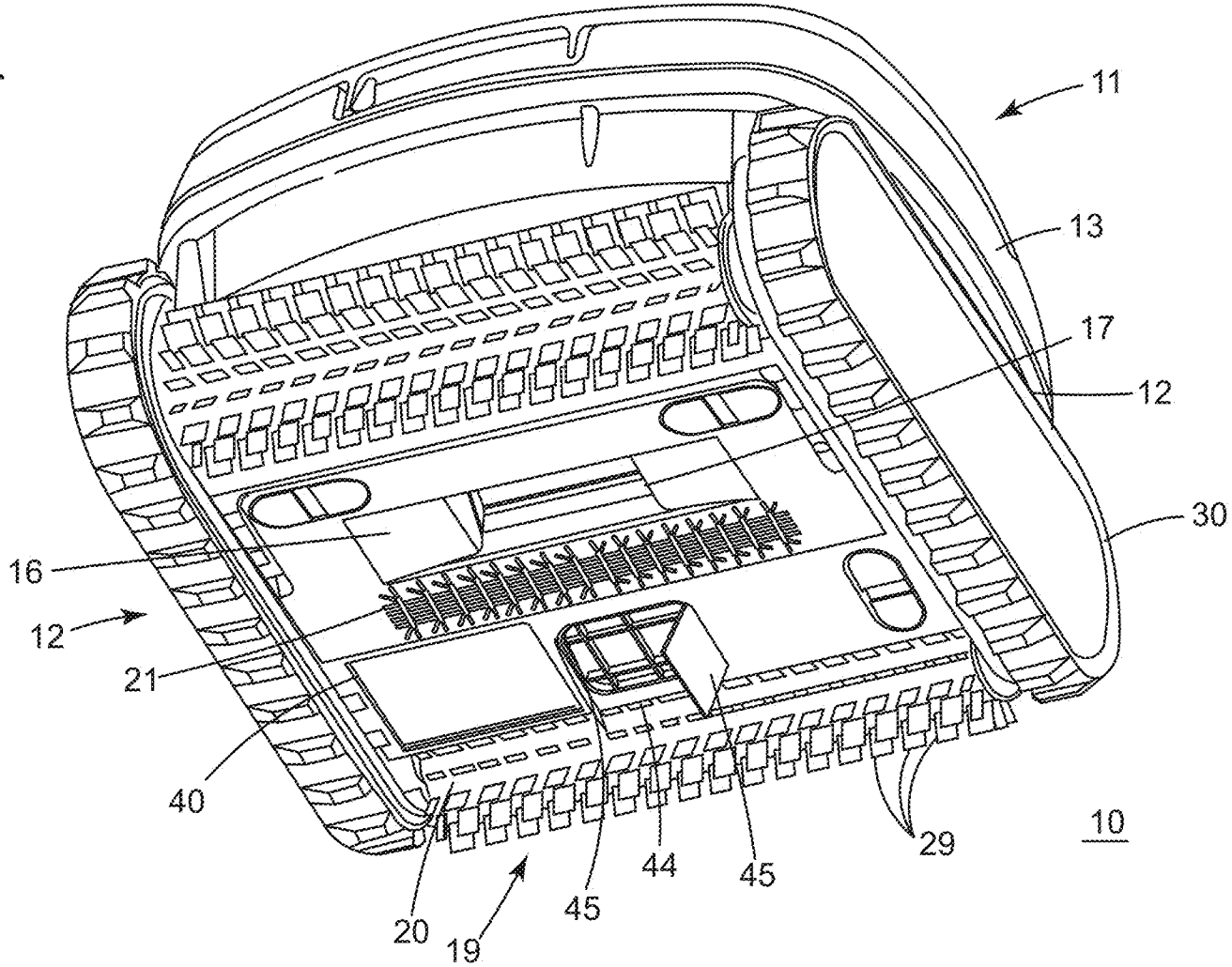
FIG. 4 is a bottom right side perspective view of a first embodiment of the cleaner of FIG. 1 illustrating a lower discharge opening for selectively releasing pressurized pool water from the bottom of the cleaner in accordance with an embodiment of the present invention.

Referring now to FIGS. 1-7, the pool cleaner 10 includes a housing 11 having a bottom/lower portion or base 12 and an upper portion which can form a cover 13 above the base 12 (FIG. 4). The base 12 and upper portion and/or cover 13 collectively define an interior chamber 14 (FIG. 6) in which a propulsion drive motor assembly 78 (FIG. 5), a filter 90, an optional battery 92, an electric water pump assembly 80, electronic controller(s) 46, sensors, optional communication circuitry, and other cleaner assemblies and components are housed.

In one embodiment, the housing cover 13 is removably secured to the base 12 to define the interior chamber 14. The cover 13 and base 12 are removably fastened with one or more fasteners such as a clasp, latch, spring clip, bolt or other well-known and conventional fasteners. A gasket or other seal (not shown) can be inserted between the base 12 and cover 13 to prevent water flowing therebetween into and out of the interior chamber 14. The cover 13 and base 12 are preferably made of a polymer, such as polyvinylchloride (PVC), polypropylene, among other well-known thermoplastic materials, aluminum and/or alloys thereof, and/or combinations thereof, and/or other corrosion resistant, water impermeable materials.

Figure 23:
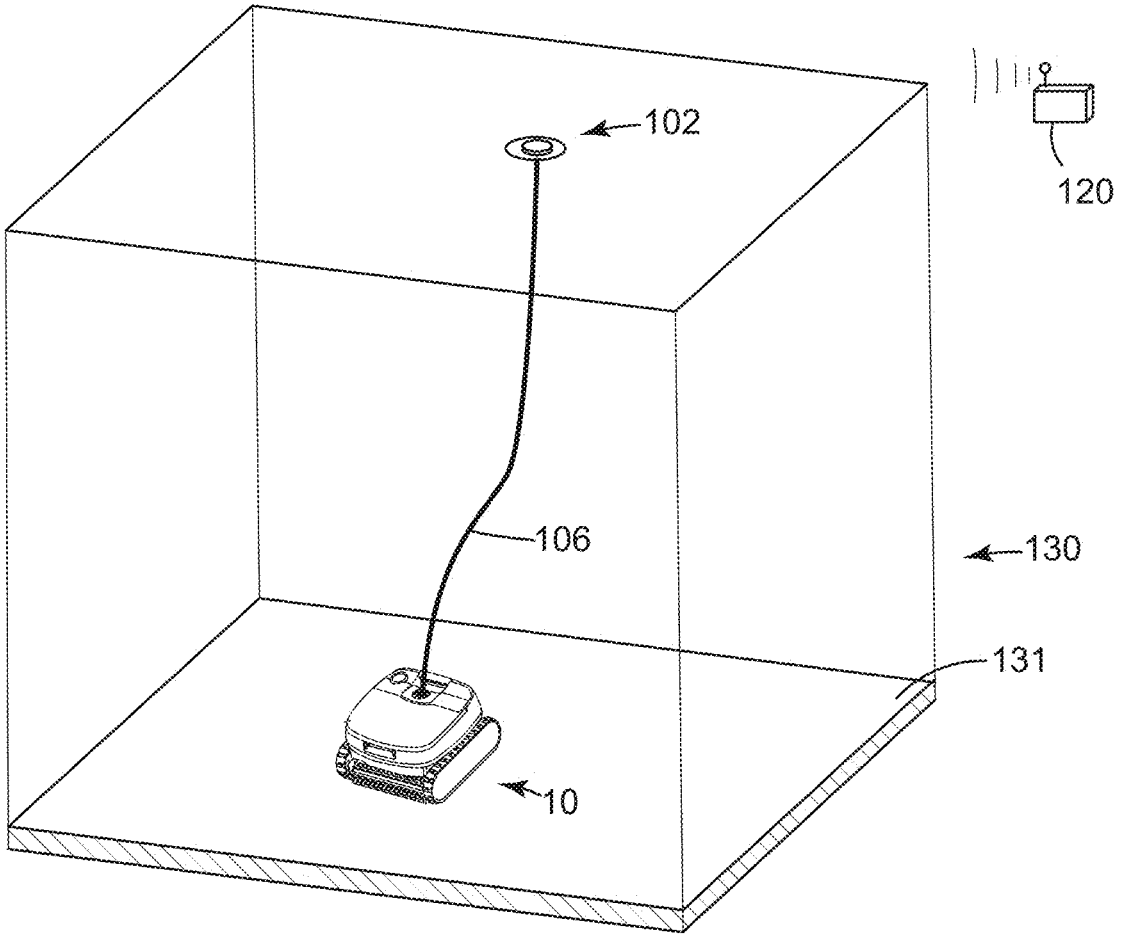
FIG. 23 is a top front perspective view of the third embodiment of the cleaner of FIG. 15 submerged in a swimming pool.

The cleaner 10 is generally configured as being negatively buoyant with a tendency towards neutral buoyancy so that the cleaner will sink or descend to the bottom when submerged in the water, but will more easily climb or be lifted out of the pool, for example, when a cleaning operation is terminated. The housing 11 can include ballast and/or floats (not shown) to achieve a desired negative/neutral buoyancy of the cleaner. In one embodiment, an external handle 75 of the cleaner 10 can be fabricated from or filled with a foam-like material to assist with floatation while the cleaner is positioned vertically on the side wall and is performing a cleaning operation along the water line of the pool. In another embodiment, the rear end of the cleaner 10 can include a ballast material while the front end includes a float to assist the cleaner when climbing a submerged surface, e.g., vertical sidewall 131 of the pool 130 (FIG. 23).

The cleaner 10 includes an upper discharge conduit or port 70 (FIG. 2) that is formed in the upper portion or cover 13 of the housing 11 and which can be directed normally or at an acute angle with respect to the surface beneath the cleaner 10. Because the cleaner 10 tends to be somewhat or substantially neutrally buoyant, the downward thrust from a water jet being discharged from the upper discharge port 70 helps to stabilize and maintain the cleaner 10 on the pool surface being cleaned. As illustratively shown in FIGS. 1, 2, 6 and 7, the upper discharge conduit or port 70 is provided at the top of the housing 11 and is preferably centrally positioned along the longitudinal axis "L" of the cleaner 10.

The robotic pool cleaner 10 includes rotationally-mounted supports 30 which are coupled to the housing 11 for moving and guiding the cleaner 10 over the submerged surface of the swimming pool or tank 130. The rotationally-mounted supports 30 are illustratively formed by track assemblies rotatably mounted to the housing and which are driven directly by one or more drive motors 78 or indirectly via a transmission assembly, which can include gears and/or pulleys and belts (not shown) to rotate the tracks 30. A person of ordinary skill in the art will appreciate that the track assemblies 30 are not considered limiting and are disclosed herein for illustrative purposes only. For example, the rotationally-mounted supports 30 can be or include one or more wheels, rollers, brushes, casters and the like. As illustrated, the rotationally-mounted supports 30 can be mounted parallel to the longitudinal axis L of the cleaner 10. In other embodiments where the rotationally-mounted supports 30 are wheels, the corresponding axles can be mounted transverse to the longitudinal axis L and/or be movable to guide and facilitate movement of the cleaner 10 in an arcuate path.

Control means (not shown) can be provided to steer and/or periodically reverse the direction of movement while performing a cleaning program, as well as to assure that the cleaner 10 does not become immobilized, e.g., by an obstacle in the pool. If, for example, the pool cleaner does not change its orientation with respect to the bottom or sidewall as indicated by a signal from an on-board sensor (e.g., tilt switch, accelerometer—which can also be used as a tilt switch, mercury switch, and the like) indicating that such transition has occurred during the prescribed period (e.g., two minutes), a control circuit will automatically reverse the polarity of the drive motor(s) 80 to change the direction of movement in order to permit the cleaner to move away from the obstacle and resume its cleaning pattern. Sensors, such as magnetic and infrared-responsive signaling devices can also be provided to change the direction of movement in response to prescribed conditions, e.g., absence of forward movement due to an obstacle. In addition, the control means can automatically steer the cleaner to the right or left while moving in either the forward or reverse direction. Power for the cleaner 10 can be supplied by an onboard battery 92, a buoyant electrical cable 60 attached to an external power source such as an external power supply, a transformer or a remote battery contained in a floating housing at the surface of the pool, although such power sources are not to be considered as limiting.

Figure 5:
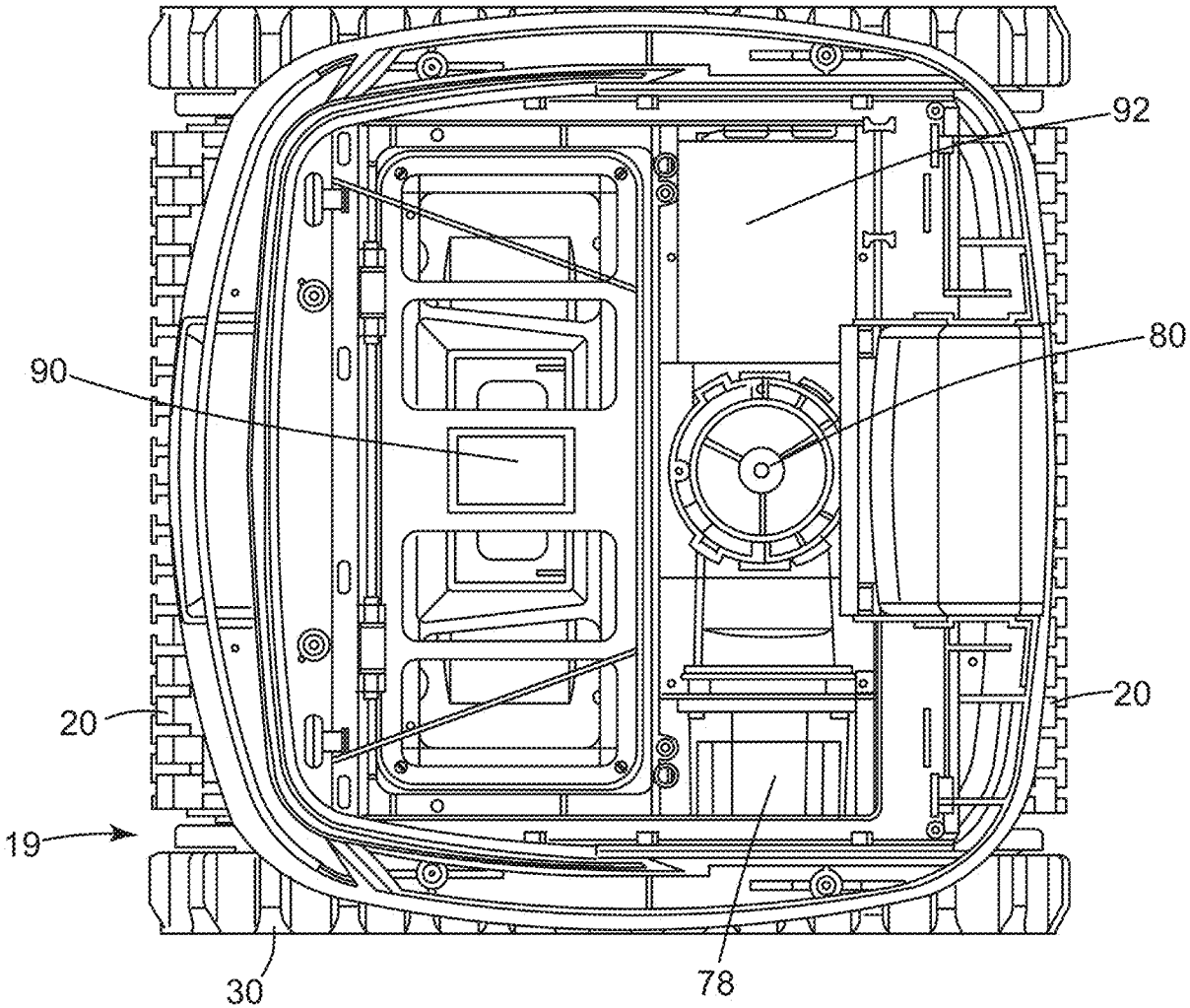
FIG. 5 is a top cross-sectional view of the first embodiment of the cleaner of FIG. 1 taken along lines B-B of FIG. 3 illustrating an embodiment of the water pump assembly.

Referring now to FIGS. 4 and 5, the cleaner 10 includes at least one water inlet port 17 formed in the lower portion 12 of the cleaner 10. Referring to FIG. 4, the bottom surface of the base 12 preferably includes an upwardly sloped or curved portion 16 formed around each water inlet port 17 to help channel or otherwise direct the flow of debris and water beneath the cleaner into the water inlet port 17.

Figure 6:
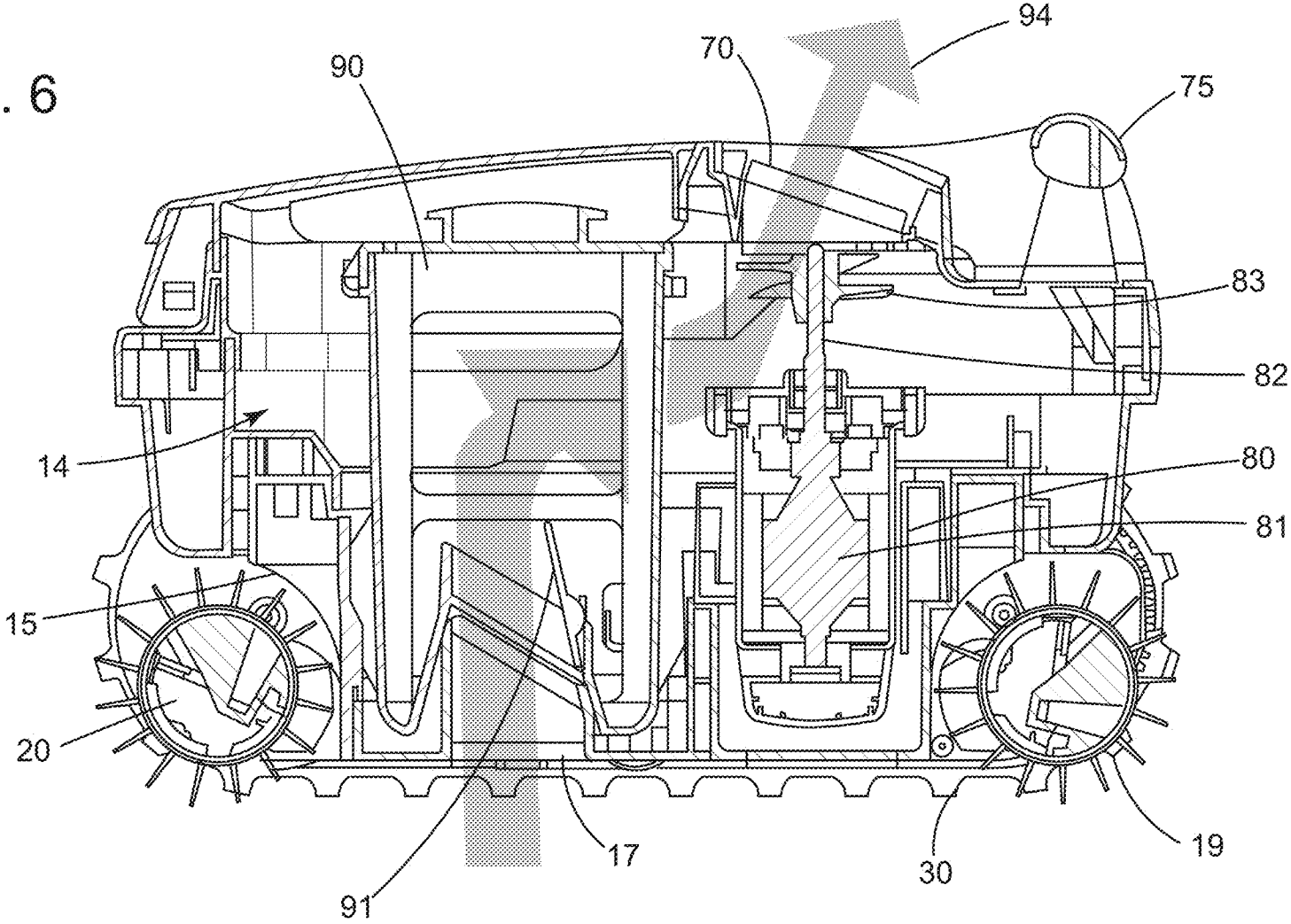
FIG. 6 is a right side, cross-sectional view of the first embodiment of the cleaner of FIG. 1 taken along lines A-A of FIG. 2 illustrating flow and filtering of pool water by the cleaner during a cleaning operation.
Figure 7:
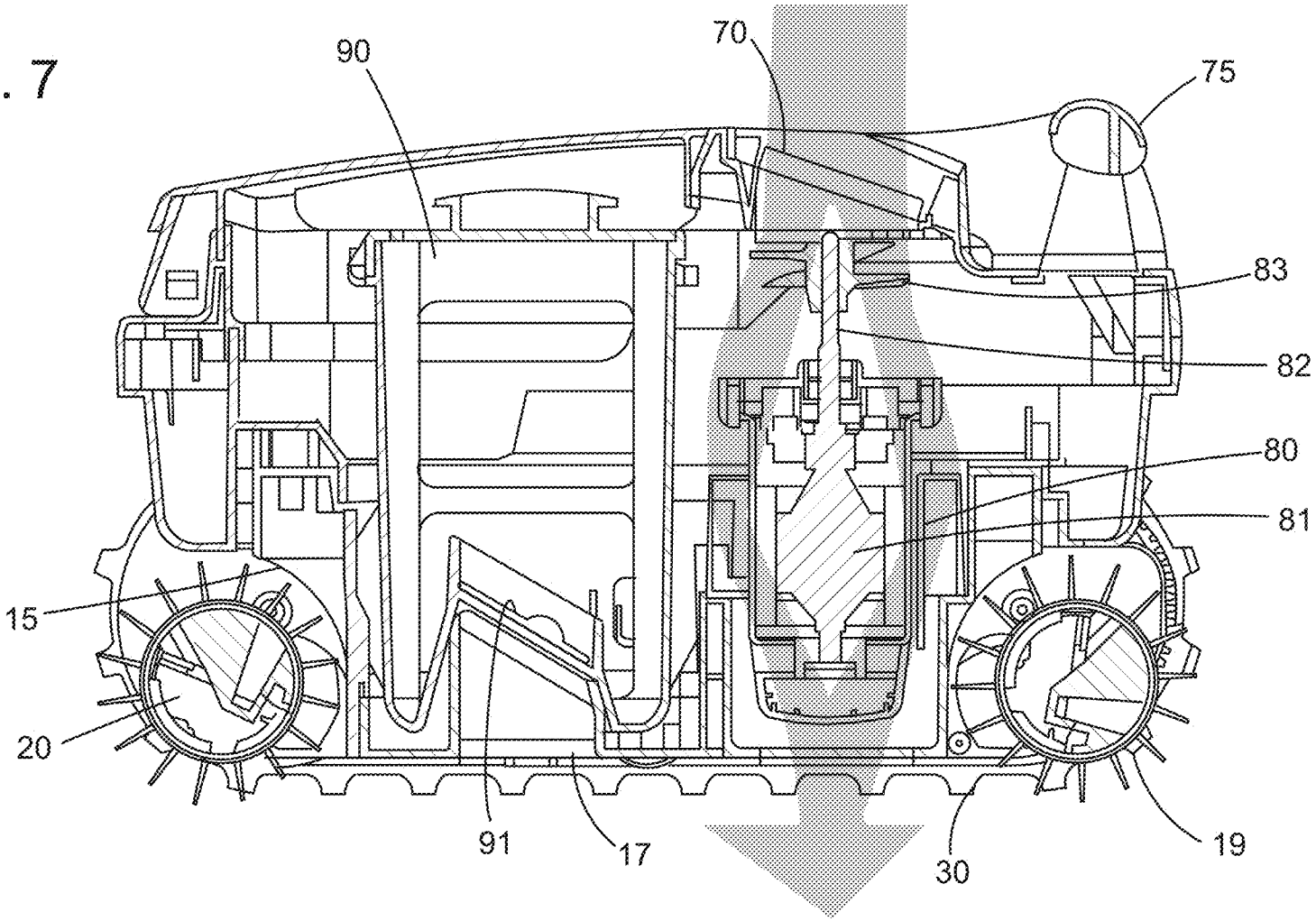
FIG. 7 is a right side, cross-sectional view of the first embodiment of the cleaner of FIG. 1 taken along lines A-A of FIG. 2 illustrating reverse flow of pool water and raising of the cleaner from the bottom surface of the pool during a non-cleaning operation.

Referring now to FIGS. 5-7, the cleaner 10 includes a filter assembly 90 that is mounted within the interior chamber 14 over the water inlet port(s) 17 (FIG. 4) of the base 12. The filter assembly 90 is illustratively shown as being a filter basket having porous walls, although such configuration is not limiting. For example, the filter assembly can be a filter cartridge, a filter bag, a filter canister, a perforated or mesh screen or any other well-known filtering device.

Referring to FIG. 6, the filter 90 is positioned over the water inlet port 17 such that water and debris from beneath the cleaner that is drawn into the interior chamber 14 is captured by the filter 90 and the debris cannot escape. A cover, check valve or flap valve 91 (FIG. 6) is provided over each water inlet port 17 to prevent reverse flow of the debris back into the pool when the cleaner 10 is powered down. The water and debris that is drawn into the cleaner via the inlet port 17 is filtered (i.e., retained) by the filter assembly 90 and the clean water that passes through the filter medium is discharged back into the pool 130 through the one or more discharge conduits/ports 70, as illustrated by large arrow 94.

Referring to FIGS. 5-7, a water pump assembly 80 is illustratively mounted in a vertical orientation in the interior chamber 14 of the cleaner 10. The water pump assembly 80 illustratively includes an electric motor 81 having a drive shaft 82 and a propeller 83. The propeller 83 is mechanically and/or magnetically rotatably coupled to the electric motor 81. In one embodiment, the electric motor 81 receives power from an on-board battery 92. Alternatively, the electric motor 81 receives power from an external power supply via a well-known electric power cable (not shown). Rotation of at the propeller 83 causes a low water pressure zone to occur at the inlet 17 so that pool water and suspended debris beneath the cleaner is drawn into the filter 90, and the filtered water is expelled from the interior chamber 14 via the discharge port 70 as a high-pressure water jet. The suctional forces at the inlet 17 and the upwardly directed high-pressure water jet at the outlet 70 collectively help maintain the cleaner 10 on the surface being cleaned. A person of ordinary skill in the art will appreciate that the discharge outlet 70 can be formed at the end of a discharge conduit (not shown) which can be positioned at an acute angle with respect to the surface beneath the cleaner such that a resultant force vector generated by the water jet has a vertical downward component to help maintain the cleaner on the bottom surface of the pool, as well as a horizontal component to assist in moving the cleaner in a forward direction, e.g., along the longitudinal axis of the cleaner.

Although the water pump assembly 80 is illustratively mounted normal (i.e., vertically) with respect to the base 12, such orientation and/or number of propellers 83 attached to the motor 81 are not considered limiting. That is, a person of ordinary skill in the art will appreciate that other water pump assembly configurations may be implemented to practice the invention. For example, the water pump assembly 80 can include a dual propeller water pump assembly, a pair of water pumps with each pump having a propeller mounted to corresponding electric motor, a single propeller motor mounted horizontally or at an angle with respect to the base 12 of the cleaner, and the like. Accordingly, the water pump assembly 80 causes the water to flow in and out of the cleaner 10 for purposes of filtering the water, as well as to stabilize and/or propel the cleaner on the surface of the pool to be cleaned.

The electric motor 81 can rotate the propeller 83 in a clockwise or counter-clockwise rotational direction, depending on the polarity of electric power provided to the pump motor 81 by the power source and/or switching circuitry therebetween. By way of example, when the propeller 83 is rotated clockwise, the pool water is drawn from beneath the cleaner into the inlet 17 and filter 90, and filtered water is discharged through the upper discharge outlet 70, as shown in FIG. 6. Reversing the rotational direction of the propeller 83 (e.g., counter-clockwise) is discussed in further detail below with respect to FIG. 7.

Referring to FIGS. 4-6, the water pump assembly 80 can also be used to rotate a roller brush 20 of a brush assembly 19 which is positioned along the bottom of the base 12 to scrub or stir up debris on the pool surface beneath the cleaner 10. In one embodiment, the drive motor(s) 78 rotate of the roller brushes 20 via a gear or pulley/belt train (not shown). Alternatively, the electric motor 81 rotate can rotate the roller brushes 20 via gear box and/or pulley/belt arrangement, and also reduce the number of rotations at a predetermined ratio to the brush assembly 19. As illustratively shown in the drawings, the brush assembly 19 comprises a roller brush 20 having a plurality of bristles or protruding cleaning elements 29. The brush 20 can be made from molded polyvinyl chloride, expanded polymeric foam having a smooth surface and polymeric foam with a resilient textured surface, a ribbed solid polymer web that is formed into a cylindrical supporting surface, among other well-known roller brush materials. A person of ordinary skill in the art will appreciate that the configuration of the brush assembly 19 is not considered limiting and is described herein for illustrative purposes only.

Referring to FIG. 4, the bottom view of the base 12 is illustratively shown. The active brushes 20 driven by the electric motor 81 are installed in a brush well 15, which extends laterally across the bottom portion at one end of the cleaner 10. Similarly, a non-driven or passive roller brush 20 can be installed in another brush well 15 and extend laterally across the opposite end of the bottom portion of the cleaner 10. The base 12 further includes an access panel 40 for accessing and replacing the battery 92 with a replacement battery. The battery access panel 40 can be hinged and/or include a latch or other fasteners for securing the battery 92 within the cleaner. In addition, a gasket is preferably provided between the access panel 40 and surrounding base to prevent the passage of water therebetween. In one aspect, a central brush 21 can also be provided (e.g., in a centrally located brush well) to stir up debris proximate the inlet 17. The central brush 21 can be actively driven via its own drive motor or via a gear/belt train from the drive motor 78. Alternatively, the central brush 21 can be a passive (non-driven) roller brush.

Figure 12:
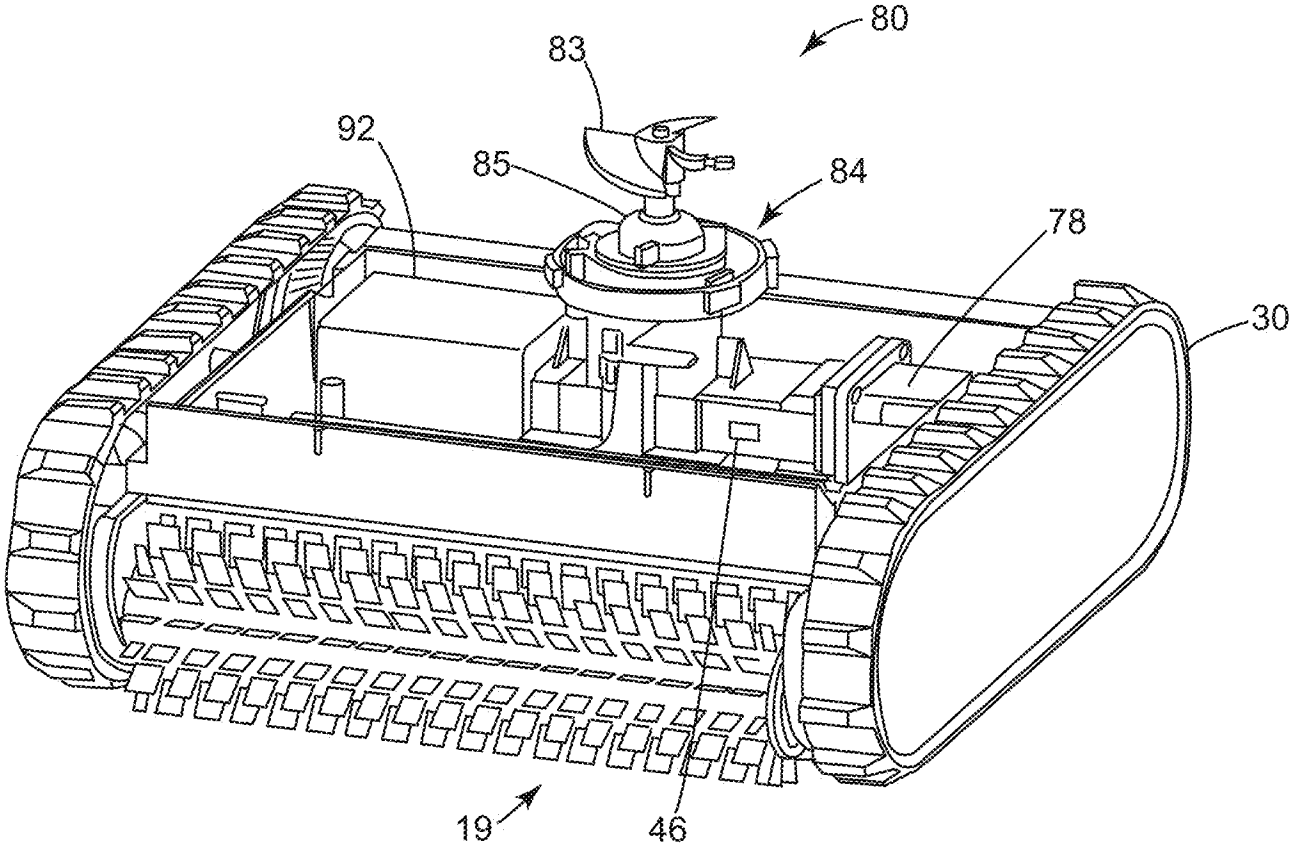
FIG. 12 is a top, front, right-side perspective view of the second embodiment of the cleaner of FIG. 9 with the housing cover removed and illustrating the water pump assembly with a coaxially aligned propeller and centrifugal pump.

The base 12 further includes a lower discharge opening or port 44 which is normally biased closed by a covering 45, such as one or more spring-loaded doors, or a check valve, or a flap valve or the like. The lower discharge port 44 and its selectively operable coveting 45 are illustratively positioned in the base 12 directly below the vertically orientated water pump assembly 80, although such positioning in the base 12 is not considered limiting. The covering 45 can be mechanically and/or magnetically biased, e.g., spring biased in a closed state and opened in response to the reversal and force of pool water flowing through the cleaner. Alternatively, the discharge port covering 45 can be selectively opened and closed in response to electronic control signals sent by a controller 46 (FIG. 12).

Referring to FIGS. 4, 6 and 7, a first embodiment for lifting the cleaner 10 off the bottom surface of the pool and raising it to the water line is discussed. As noted above, the cleaner 10 has a somewhat negative buoyancy that is sufficient to enable the cleaner 10 to expediently and lightly/gently descend to the bottom surface of the pool so that the pool surface and the cleaner are not damaged upon impact. As the cleaner 10 is almost neutrally buoyant, the present invention implements a downwardly directed water jet which pushes and otherwise lifts the cleaner off the bottom surface of the pool, and raises or "propels" the cleaner in an upwardly direction to the waterline when a cleaning operation is halted or otherwise terminated.

Referring to FIG. 7, when the cleaner 10 has halted its cleaning program because a predetermined condition is satisfied, such as the cleaning program is completed, a low battery power indication, the filter is full, a blockage is sensed, the end-user decides to remove the cleaner from the pool or the like, the controller 46 sends a command signal to the electric motor 81 to reverse the rotational direction of the propeller 83, which causes the pool water to flow in a reverse direction, as illustrated by arrow 95.

For example, where the on-board battery 92 is installed, a battery power sensor/circuitry is provided to monitor the current/voltage level of the battery and send an electronic signal to an on-board controller 46 when a predetermined (low) power level of the battery is sensed. The controller 46 receives the signal from the battery sensor and sends a command signal to the electric motor 81 to reverse its direction of rotation, e.g., from clockwise to counter-clockwise. When the propeller 83 reverses its rotational direction, a low pressure zone is formed at the upper discharge outlet 70 to draw in water from the pool, and a high pressure flow of water is formed in the interior chamber 14 which closes the flap valve 91 of the filter 90 and opens the cover or flap valve 45 of the lower discharge port 44 to expel a high-pressure water jet in a direction towards the bottom surface of the pool. The water jet expelled from the base 12 is sufficient to overcome the negative/neutral buoyancy of the cleaner and lift the cleaner 10 off the surface of the pool and continue to raise the cleaner to the waterline. The end user can then retrieve the cleaner 10 by grasping the handle 75 of the cleaner 10 by hand or with a conventional poolside retrieving pole.

In one aspect, the controller 46 of the cleaner includes programing to move the cleaner to a sidewall of the pool once the controller 46 receives the electronic signal signifying that the above-described predetermined condition was satisfied (e.g., low battery signal example, cleaning program is finished, and the like). The movement of the cleaner to the sidewall of the pool occurs prior to reversing the rotational direction of the propeller 83 to thereby enable the end-user to more easily grasp the cleaner 10 from the waterline at the edge of the pool without using an extension pole. The end-user can then retrieve the cleaner 10 to perform a maintenance routine, e.g., install a replacement battery, empty/clean the filter, and the like, and/or park and store the cleaner for future use.

Figure 8:
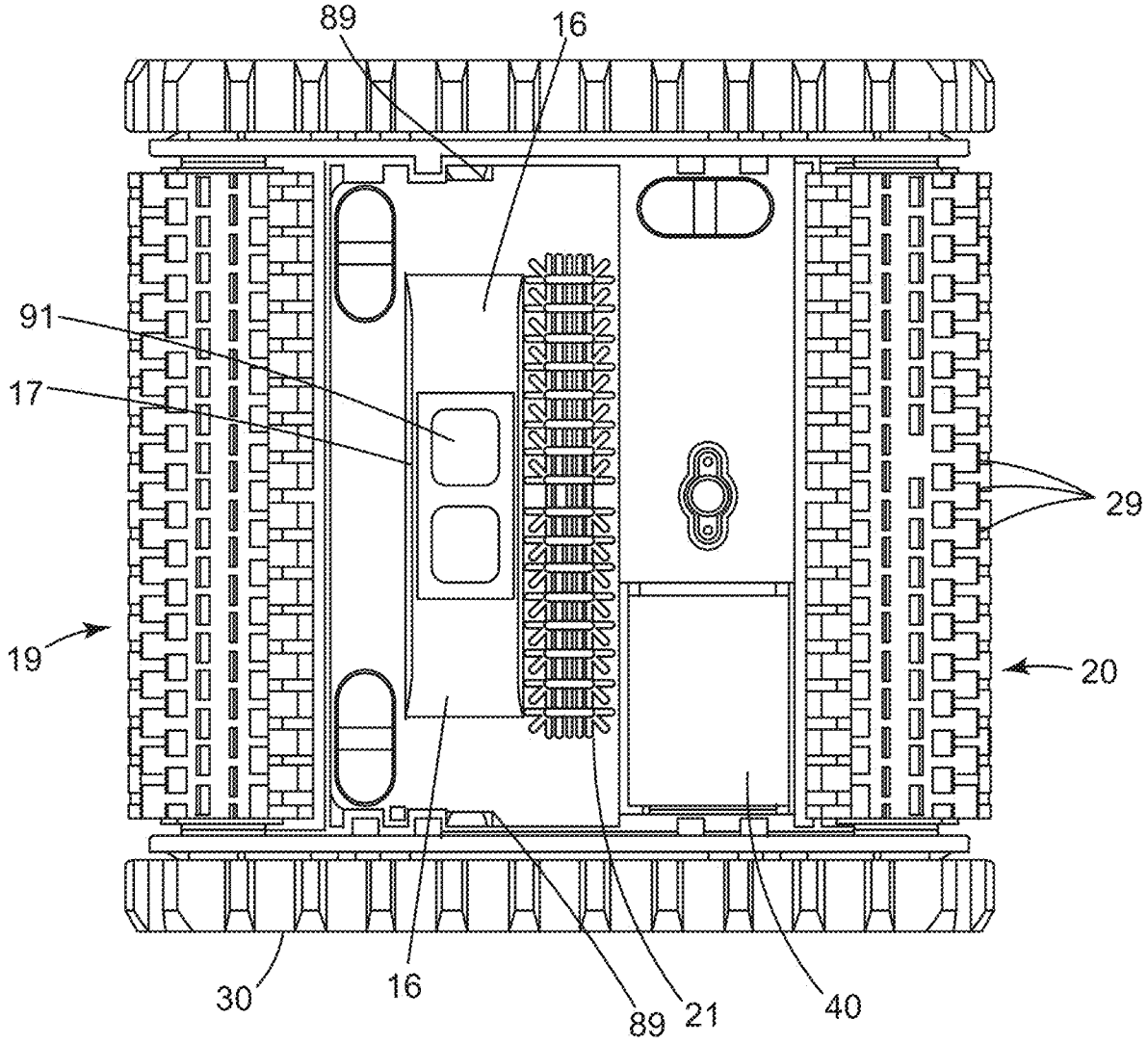
FIG. 8 is a bottom plan view of a second embodiment of the cleaner of FIG. 1 illustrating jet nozzles provided on the bottom of the cleaner in accordance with an embodiment of the present invention.
Figure 9:
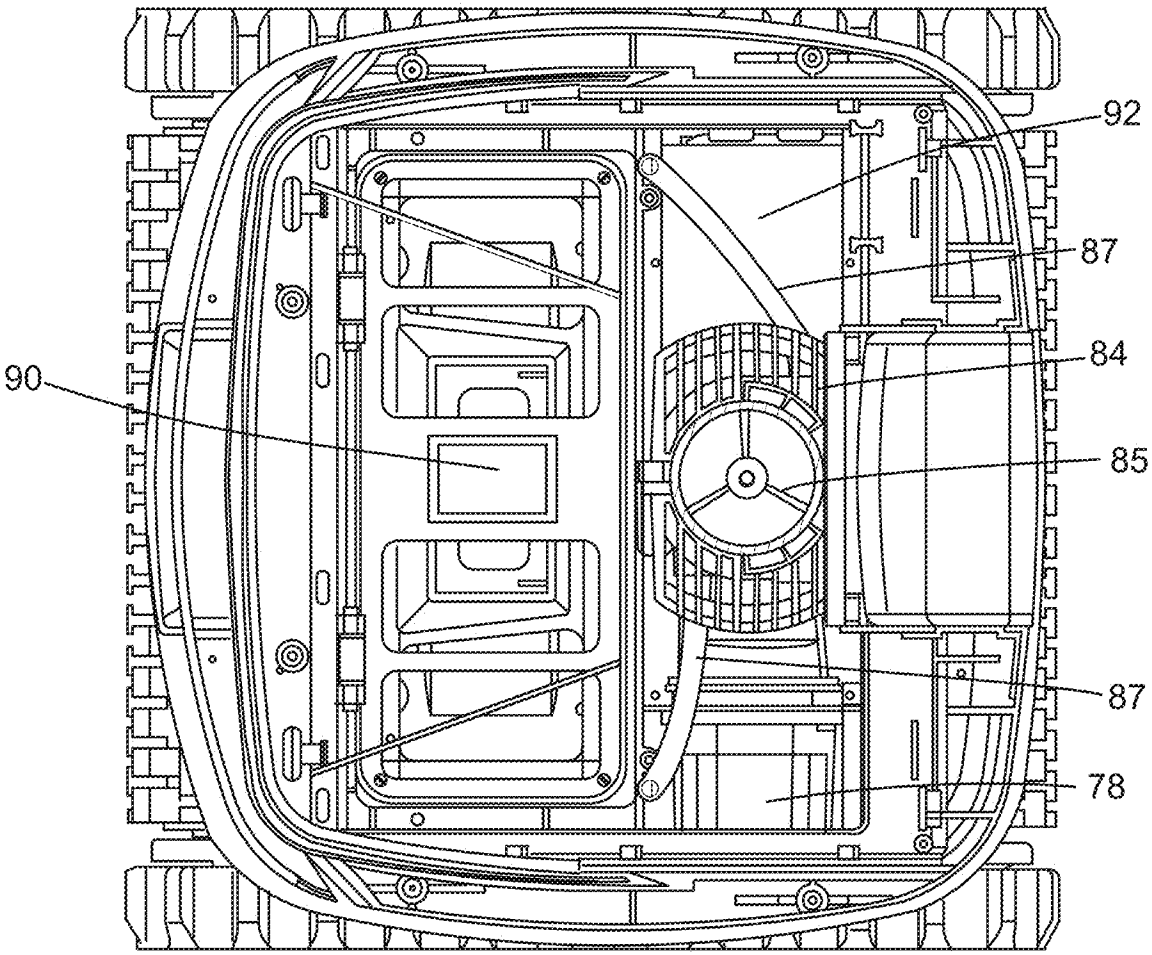
FIG. 9 is a top cross-sectional view of the second embodiment of the cleaner of FIG. 1 taken along lines B-B of FIG. 3 illustrating another embodiment of the water pump having a centrifugal pump.

Referring now to FIGS. 8-14, a second embodiment of using a high-pressure water jet to lift and raise the cleaner off the bottom surface of the pool to the water line for retrieval by an end-user is illustratively shown. Referring to FIG. 8, at least one water jet nozzle 89 is provided on the bottom of the cleaner and is directed to the bottom surface 12 of the pool. Although a pair of nozzles 89 is provided on each side of the bottom surface 12 of the cleaner 10, the number of nozzles 89 is not considered limiting. It is noted that in the second embodiment of the cleaner, the lower discharge port 44 and its valve 45 are not implemented as shown in the first embodiment with respect to FIGS. 4-7.

Figure 13:
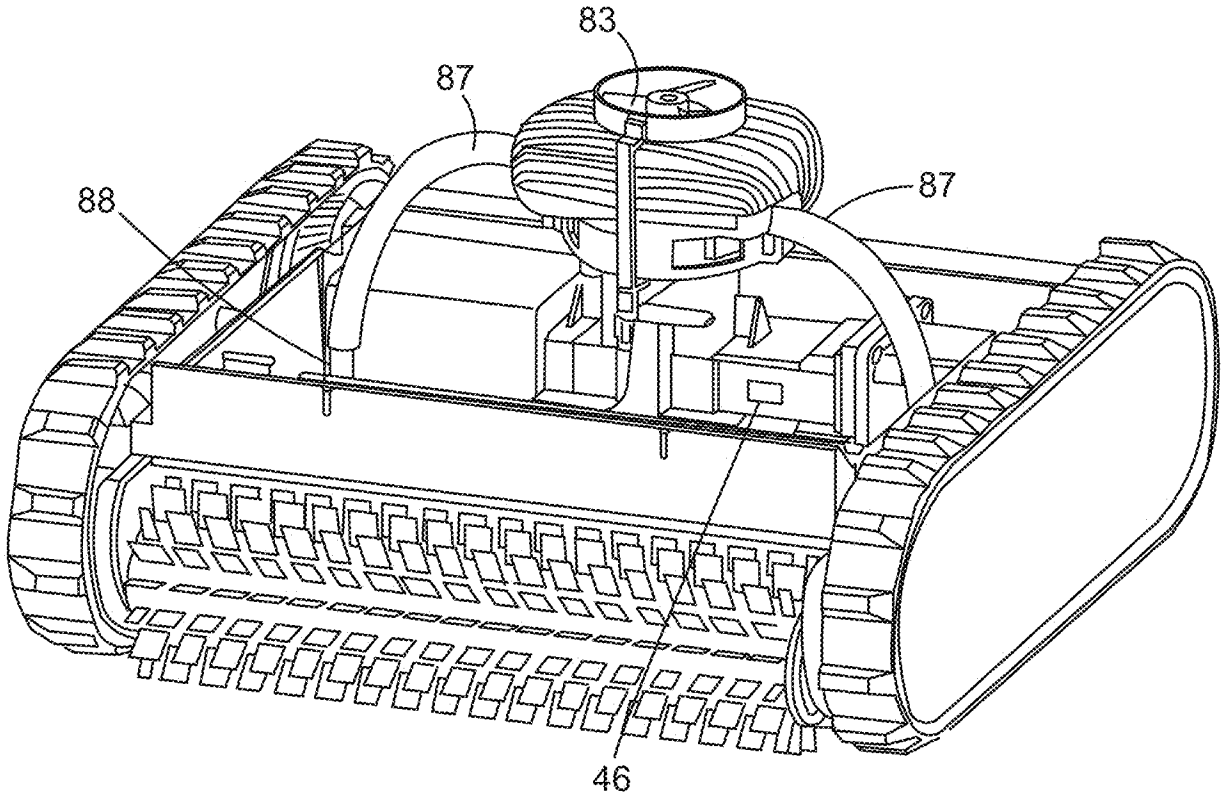
FIG. 13 is a top, front, right-side perspective view of the second embodiment of the cleaner of FIG. 12 with the housing cover removed and illustrating a pump housing of the water pump assembly and conduits that channel high pressure water to the jet nozzles provided on the bottom of the cleaner.
Figure 14:
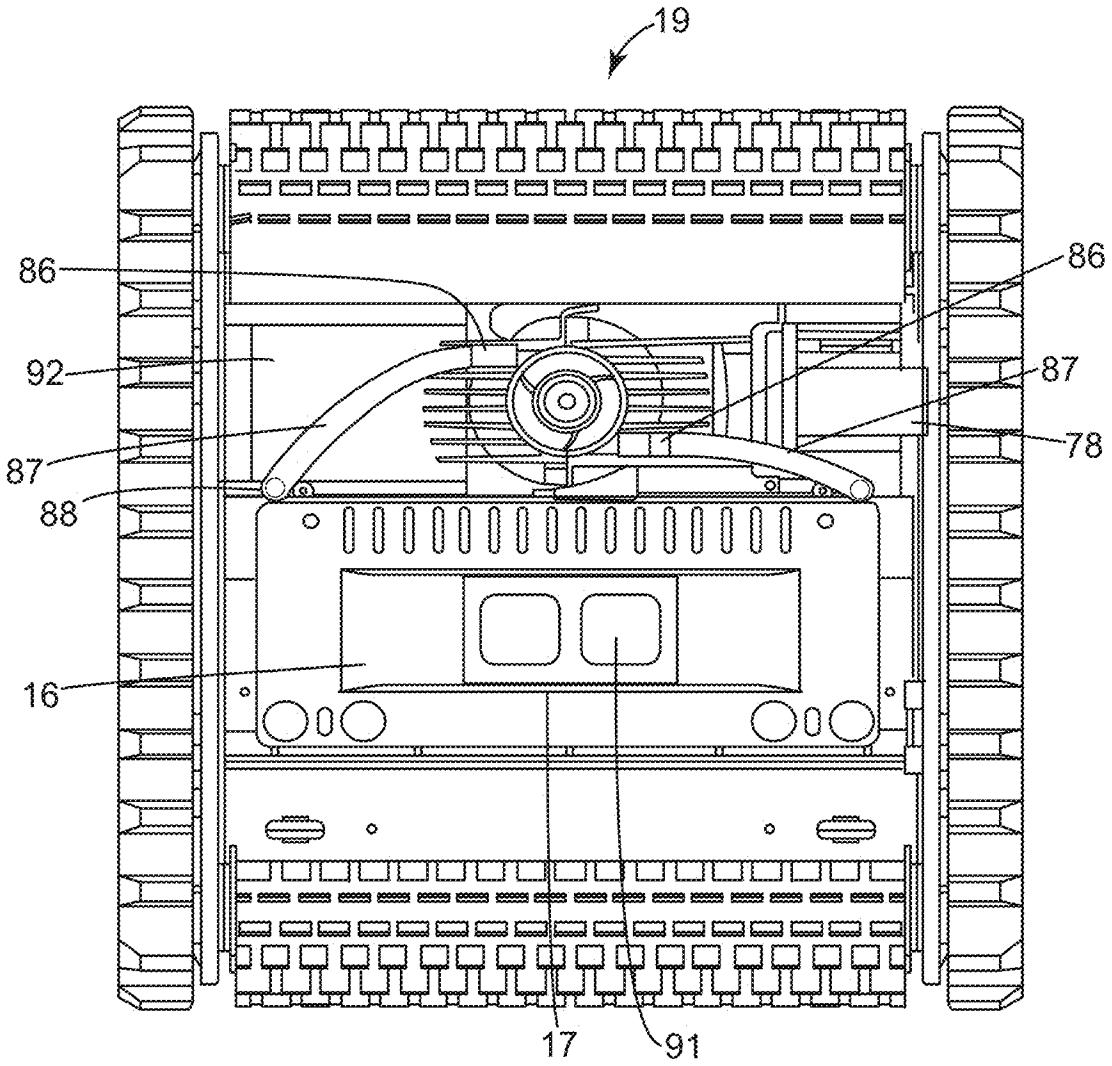
FIG. 14 is a top cross-sectional view of the second embodiment of the cleaner taken along lines C-C of FIG. 3 illustrating the tubing conduits connected between outlets of the centrifugal pump and inlet portions of the jet nozzles.

Referring to FIGS. 12-14, the water pump assembly 80 includes a centrifugal pump 84 which is in fluid communication with each inlet 88 of the nozzles 89 via conduits 87 such as flexible tubing, and the like. In one aspect, the centrifugal pump 84 includes a rotatable impeller 85 that is mechanically and/or magnetically attached to the motor shaft 82. The impeller 85 is preferably coaxially aligned with the propeller 83 of the water pump assembly 80, although such arrangement is not considered limiting. For example, the impeller 85 and/or propeller 83 can be attached to the motor via a gear/belt drive arrangement. The rotatable impeller 85 includes a plurality of blades (FIG. 12) and at least one outlet 86 (FIG. 14) provided on the pump motor housing 79. The pump motor 81 rotates the shaft 82, which in turn rotates both the impeller 85 and the propeller 83. In one embodiment, the blades of the impeller 85 are configured for unidirectional flow such that water will flow from the centrifugal pump 84 only when the motor 81 and propeller 83 are rotated in a reverse direction during a non-cleaning operation. Alternatively, the centrifugal pump 84 can be located in the interior chamber 14 separate and apart from the water pump motor shaft 82 and connected by a linkage (gear box and/or pulley/belt linkage) to the electric motor 81 or to a second electric motor (not shown).

Figure 10:
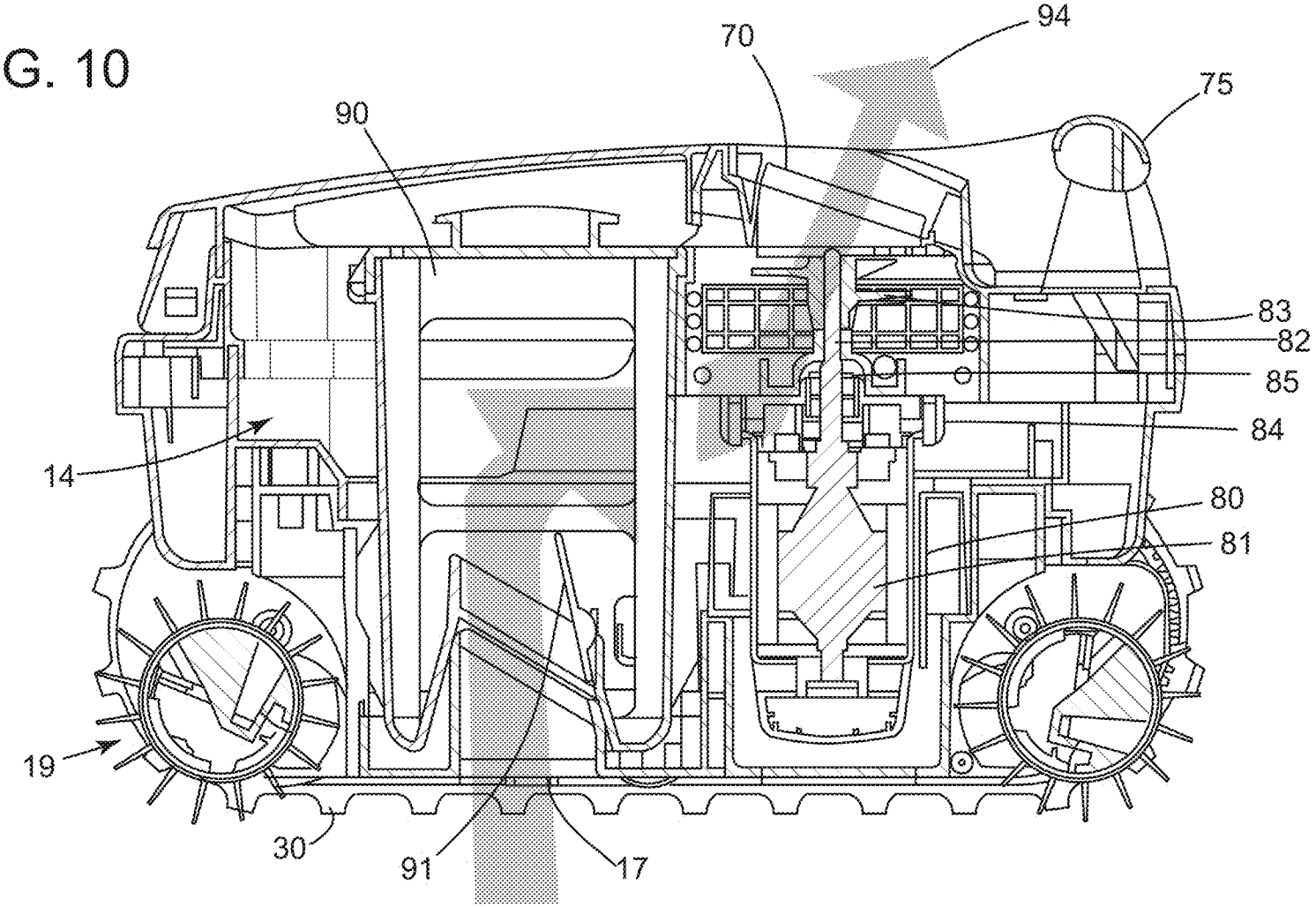
FIG. 10 is a right side, cross-sectional view of the second embodiment of the cleaner of FIG. 1 taken along lines A-A of FIG. 2 illustrating flow and filtering of pool water by the cleaner during a cleaning operation.

Referring to FIG. 10, as the impeller 85 is rotated by the electric motor 81 in a first direction during a cleaning operation, the propeller 83 draws the pool water through the inlet 17 and into the filter 90 for capturing debris, and the filtered water passes from the filter medium into the interior chamber 14, and is expelled through the upper discharge port 70 as a high-pressure jet stream, as illustratively shown by arrow 94 and discussed above with respect to FIGS. 1-7. During the cleaning operation, the impeller blades rotate, but the configuration of the blades is such that they do generate a high-velocity/pressure stream out of the centrifugal pump 84. In one embodiment, the blades of the impeller 84 can be configured to produce a minimal flow of water out of the nozzles 89 which is sufficient to stir up dirt and debris on a surface of the pool, but not sufficient to cause any lifting or raising of the cleaner 10 from the bottom surface of the pool during the cleaning operation.

Figure 11:
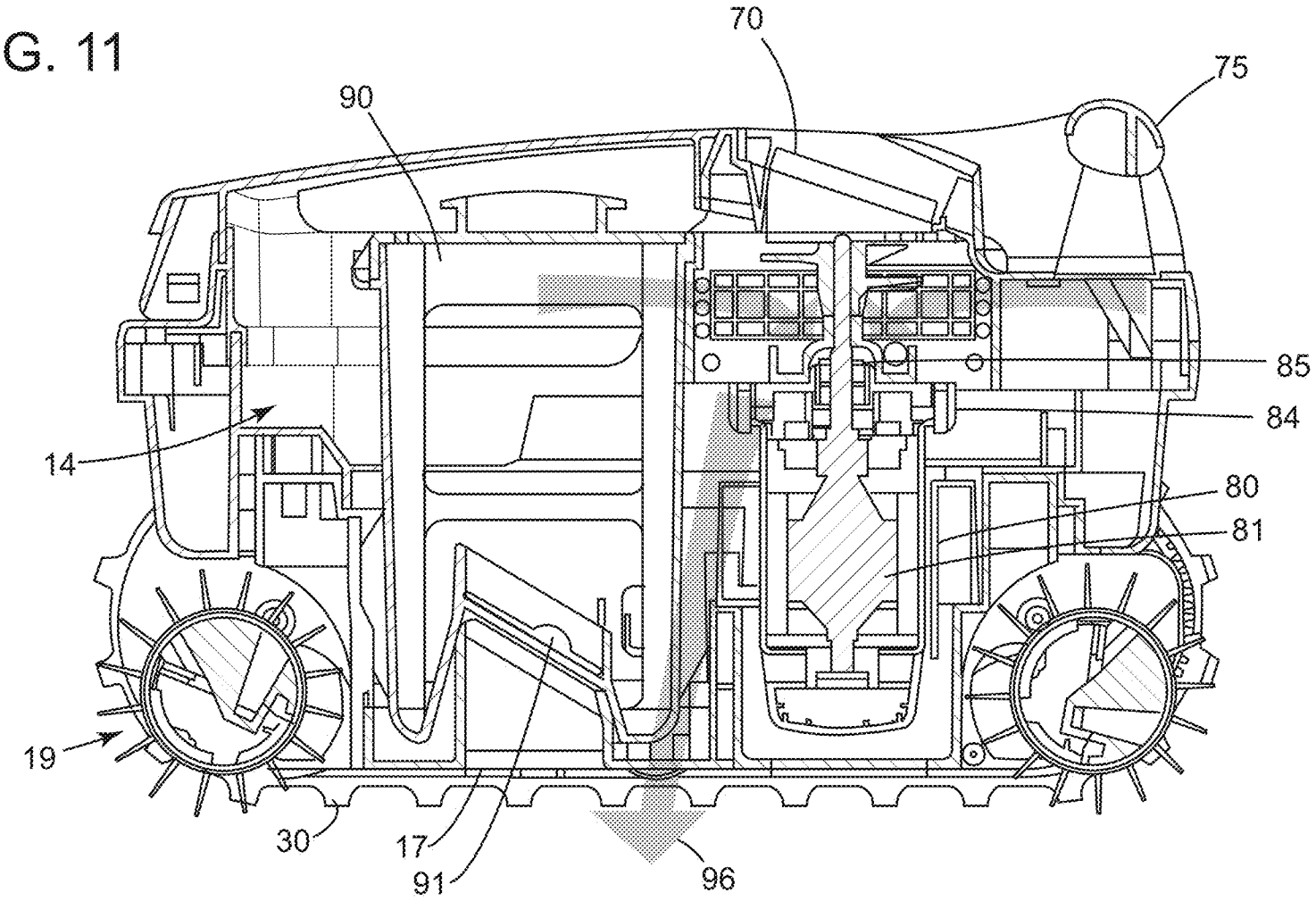
FIG. 11 is a right side, cross-sectional view of the second embodiment of the cleaner of FIG. 1 taken along lines A-A of FIG. 2 illustrating reverse flow of pool water and raising of the cleaner from the bottom surface of the pool during a non-cleaning operation.

Referring to FIG. 11, as the impeller 85 is rotated by the electric motor 81 in a reverse direction during a non-cleaning operation, the unidirectional impeller blades force the water from the interior chamber 14 in a direction normal to the central axis of the impeller 84 and at a high velocity into the outlets 86. The conduits 87 channel the high velocity and pressurized water from the centrifugal pump 84 to the inlets 88 of the nozzles 89, which are configured to produce a pressurized water jet that is discharged in a direction towards the bottom of the pool to lift and raise the cleaner 10, as illustrated by arrow 96. As discussed above with regard to the embodiment of FIGS. 1-7, the reversal of the pump motor 81 also causes the flap valve 91 of the filter 90 to close, thereby prohibiting any captured debris from escaping the filter 90 and out the inlet 17.

Referring now to FIGS. 15-23, a third embodiment of the cleaner 10 is illustratively shown. The cleaner 10 configuration is generally the same as the previous embodiments that were illustrated and discussed above with respect to FIGS. 1-14, except that a retractable buoy assembly 102 is tethered to the cleaner 10 via a reinforced cable line 106, and the downwardly directed water jet(s) expelled through the lower discharge port and/or through the nozzles 89 are optional, but not required.

The buoy assembly 102 illustratively includes a housing 104 and a handle 110. The handle 110 (e.g., a rotatable handle) is preferably provided on the buoy assembly 102 to enable an end user to grasp and lift the cleaner 10 out of the pool as discussed in further detail below. The buoy assembly housing 104 and/or the handle 110 are fabricated at least in part from a buoyant (e.g., foam-like) material to assist with floatation of the buoy assembly 102 while the cleaner 10 is performing a cleaning operation on a submerged surface 131 of the pool 130. The buoyancy of the buoy 102 is greater than the buoyancy of the cleaner 10 such that retraction of the cable line 106 will not result in the buoy being submersed below the water line. Rather, the buoy assembly 102 remains floating on the water surface of the pool so that the near neutrally buoyant cleaner can be raised upwards to the floating buoy assembly 102 when "reeled in", as discussed below in greater detail.

Figure 18:
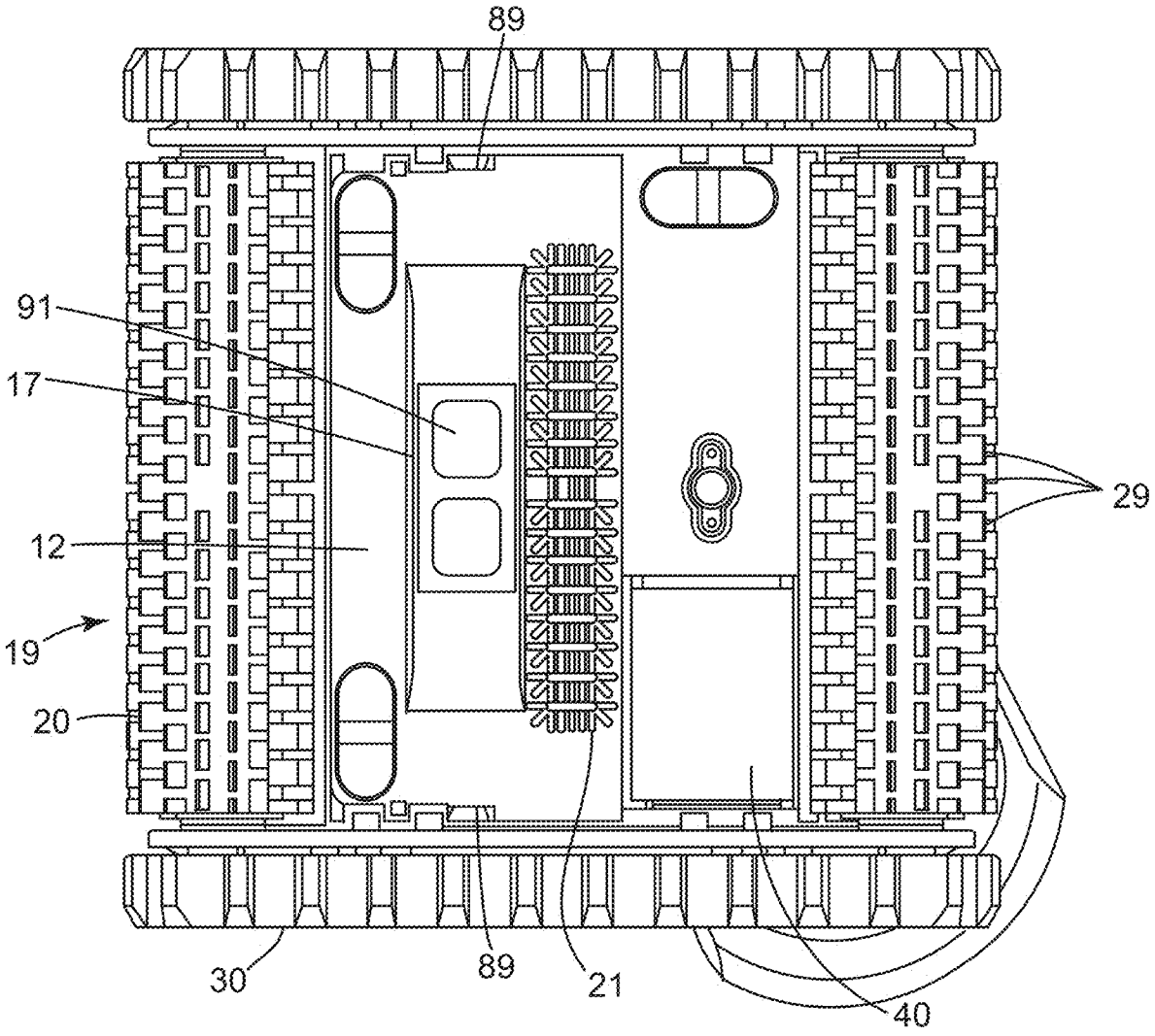
FIG. 18 is a bottom plan view of the cleaner of FIG. 15.
Figure 19:
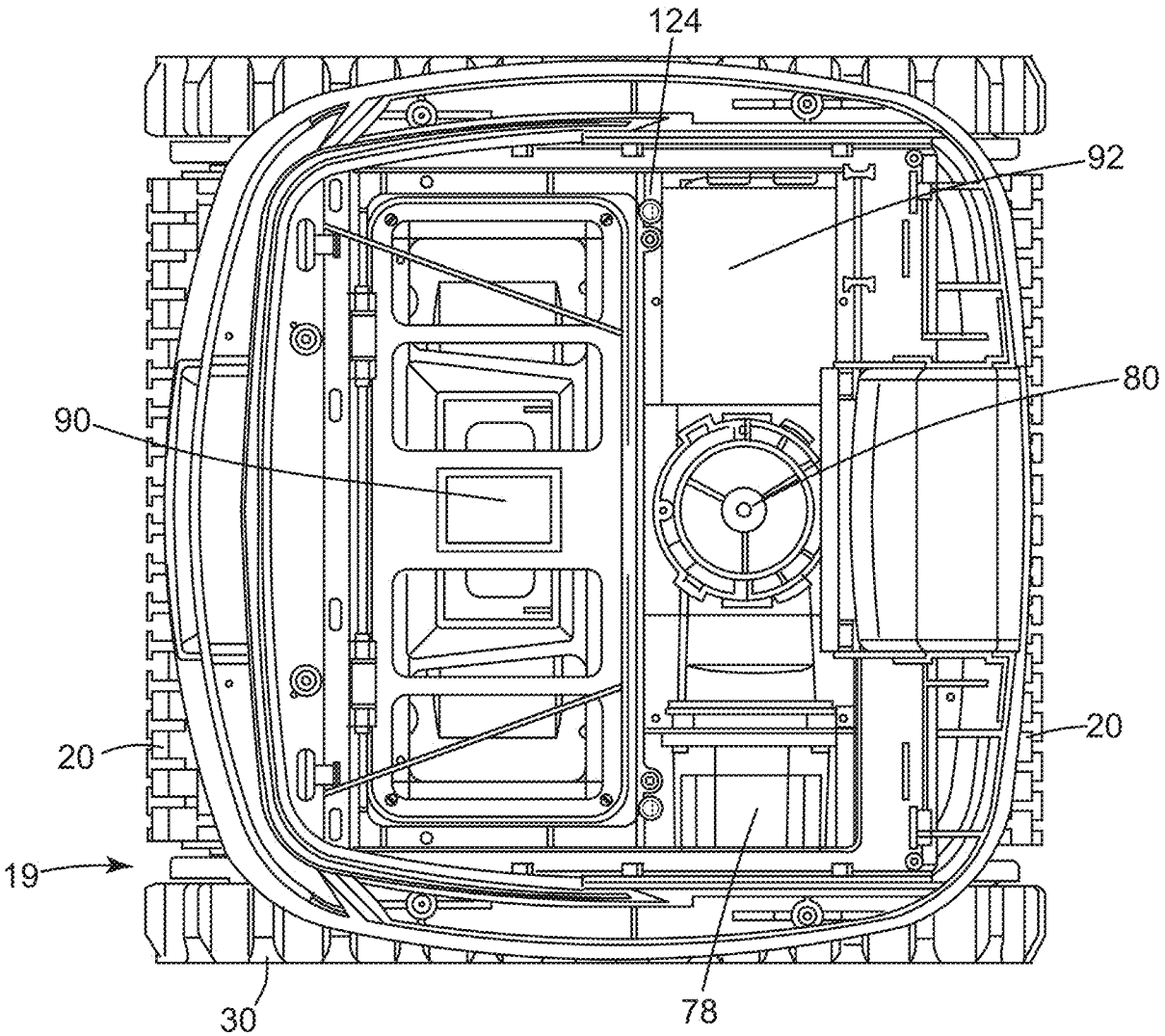
FIG. 19 is a top cross-sectional view of the cleaner of FIG. 15 taken along lines B-B of FIG. 17.

Referring to FIG. 18, the cleaner 10 illustratively does not include the lower discharge port 44 in the base 12 as previously shown and described with respect to FIGS. 1-7, or the centrifugal pump 84 and nozzles 89 as previously shown and described with respect to FIGS. 8-14. Rather, the configurations of the first or second embodiments are considered optional features in the third embodiment. A top plan view of the water pump assembly 80 mounted in the interior chamber 14 of the cleaner 10 is depicted in FIG. 19.

Figure 22:
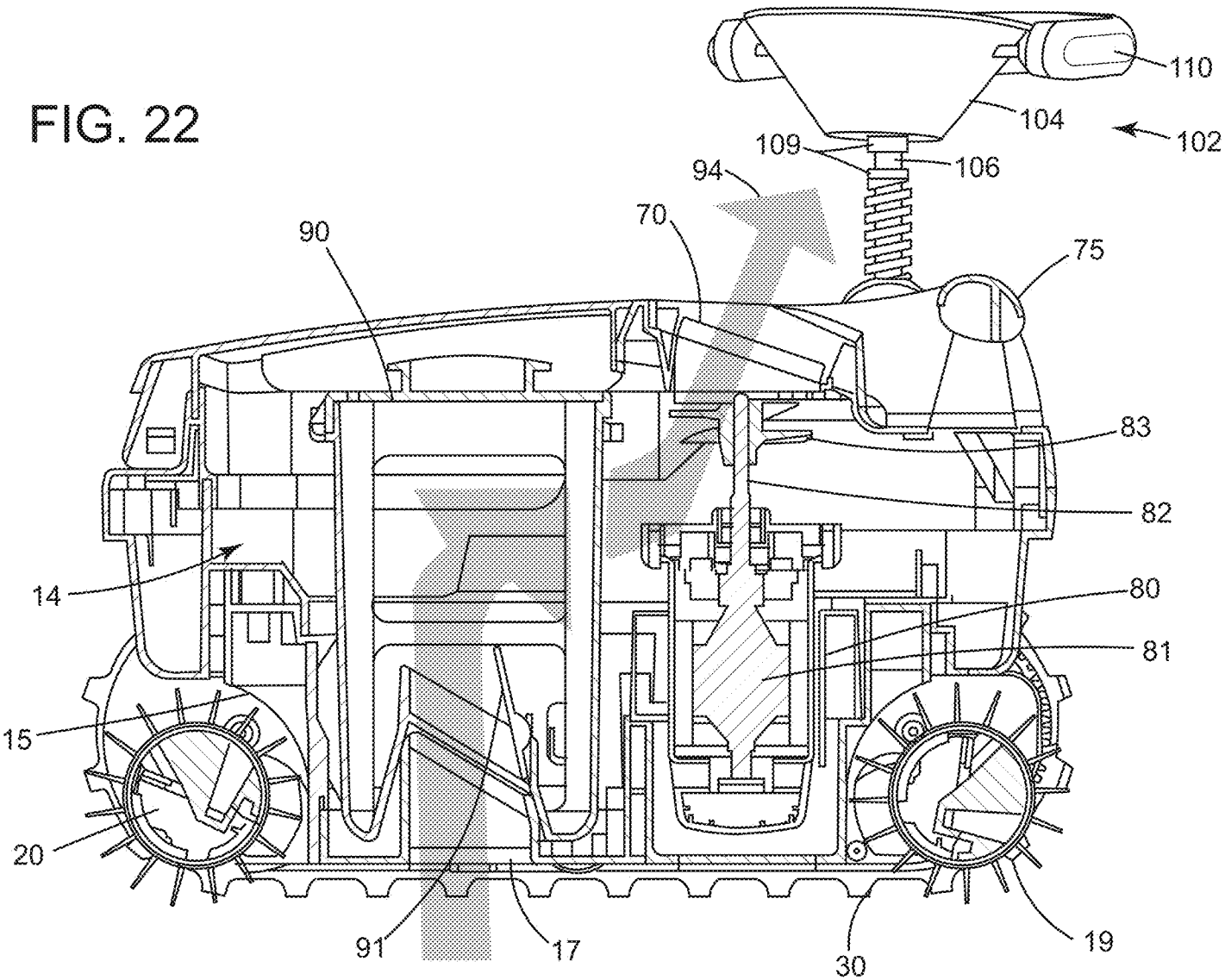
FIG. 22 is a right side cross-sectional view of the third embodiment of the cleaner of FIG. 15 taken along lines A-A of FIG. 16 illustrating flow and filtering of pool water by the cleaner during a cleaning operation.

FIG. 22 is a cross-sectional side view of the cleaner 10 illustrating, via arrow 94, the flow of water and debris through the cleaner 10 during a cleaning operation, as discussed above with respect to the first and second embodiments of FIGS. 1-14 In an embodiment where the pump motor 81 is also a driving motor (via a linkage) for the rotationally-mounted supports 30, its rotational direction can be reversed so as to continue cleaning the pool by causing the rotationally-mounted supports tracks or wheels) to reverse the directional movement of the cleaner and discharge the filtered water through the upper discharge conduit 70. However, a jet force to lift and raise the cleaner as discussed above with respect to the first and second embodiments of FIGS. 1-14 is optional.

Figure 20:
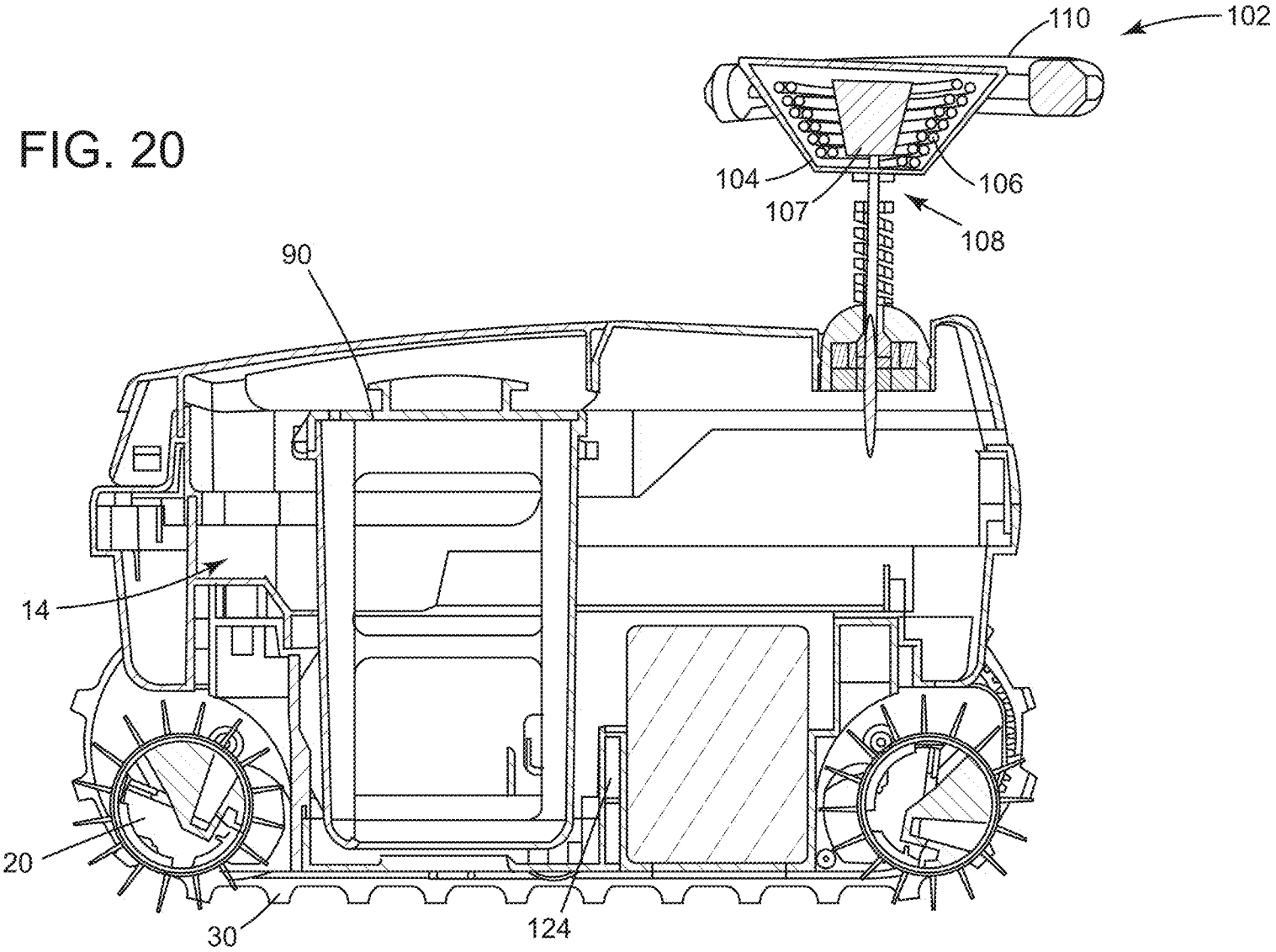
FIG. 20 is a right side, cross-sectional view of the third embodiment of the cleaner of FIG. 15 taken along lines C-C of FIG. 16 illustrating a buoyant communications receiver assembly of the present invention.
Figure 21:
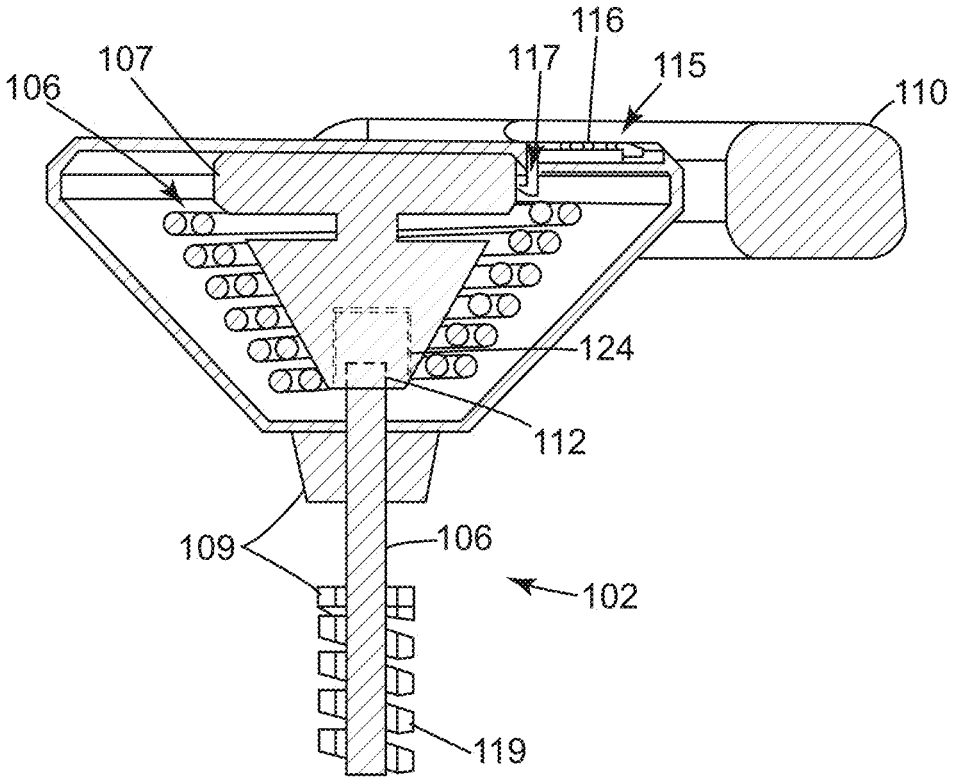
FIG. 21 is an enlarged cross-sectional view of the buoy assembly of FIG. 15 illustrating a retractable spooled cable and locking mechanism.

Referring now to FIGS. 20 and 21, preferably, the retractable cable 106 is wound about a spool or spindle 107 that is rotatably mounted in buoy assembly 102. Alternatively, the spool 107 and retractable cable 106 are mounted on-board the cleaner 10, on the housing 11 or within the interior chamber 14 of the cleaner 10. The spool 107 can be configured with a spool rotation mechanism 112 so that the retractable cable 106 is adjustable in length as the buoy assembly 102 floats on the water surface and the cleaner 10 traverses at different depths of the pool. The spool rotation mechanism 112 can include a resilient member or spring to form a spring-loaded spool, an electric motor (e.g., solenoid), or otherwise be configured to automatically adjust the length of the cable 106 such that there is minimal slack as between the cleaner 10 and the buoy assembly 102. The buoyancy of the buoy assembly 102 is sufficient to overcome the negative buoyancy of the cleaner 10 and thereby assist in lifting and raising the cleaner 10 off the bottom surface of the pool when retracting the cable 106.

Referring now to FIG. 21, in an embodiment where the spool 107 operates with a rotation mechanism 112 that is a spring, a first locking mechanism 115 is provided to selectively lock the spool 107 or the cable 106 so that the length of the cable 106 does not change. For example, the spool 107 can include a centralized spring 112 (drawn in phantom) and the locking mechanism 115 can include a latch 116 that interfaces with a strike member 117 formed on the outer surface of the spool 107. When the latch 116 and strike member 117 are disengaged, the spool spring recoils to retract and wrap the cable 106 about the outer surface of the spool 107. When the latch 116 is engaged with the strike member 117, the length of cable 106 is held constant. In another aspect, a tensioner or drag mechanism (not shown) can be provided to allow the length of cable to increase as the cleaner 10 moves along deeper portions of the pool 130 and then retract when moving to shallower areas of the pool. Alternatively, in an embodiment where the spool 107 operates with a rotation mechanism 112 that is an electric motor, the first locking mechanism 115 is not required and the controller 46 or 120 can provide command signals to the spool motor 112 to rotate in direction to either retract or release the cable 106. For example, a command signal from a remote controller can be sent to reverse the spool motor direction (or release the locking mechanism) to retract the cable 106 and thereby cause and/or assist the cleaner to rise from the submerged surface of the pool.

Figure 15:
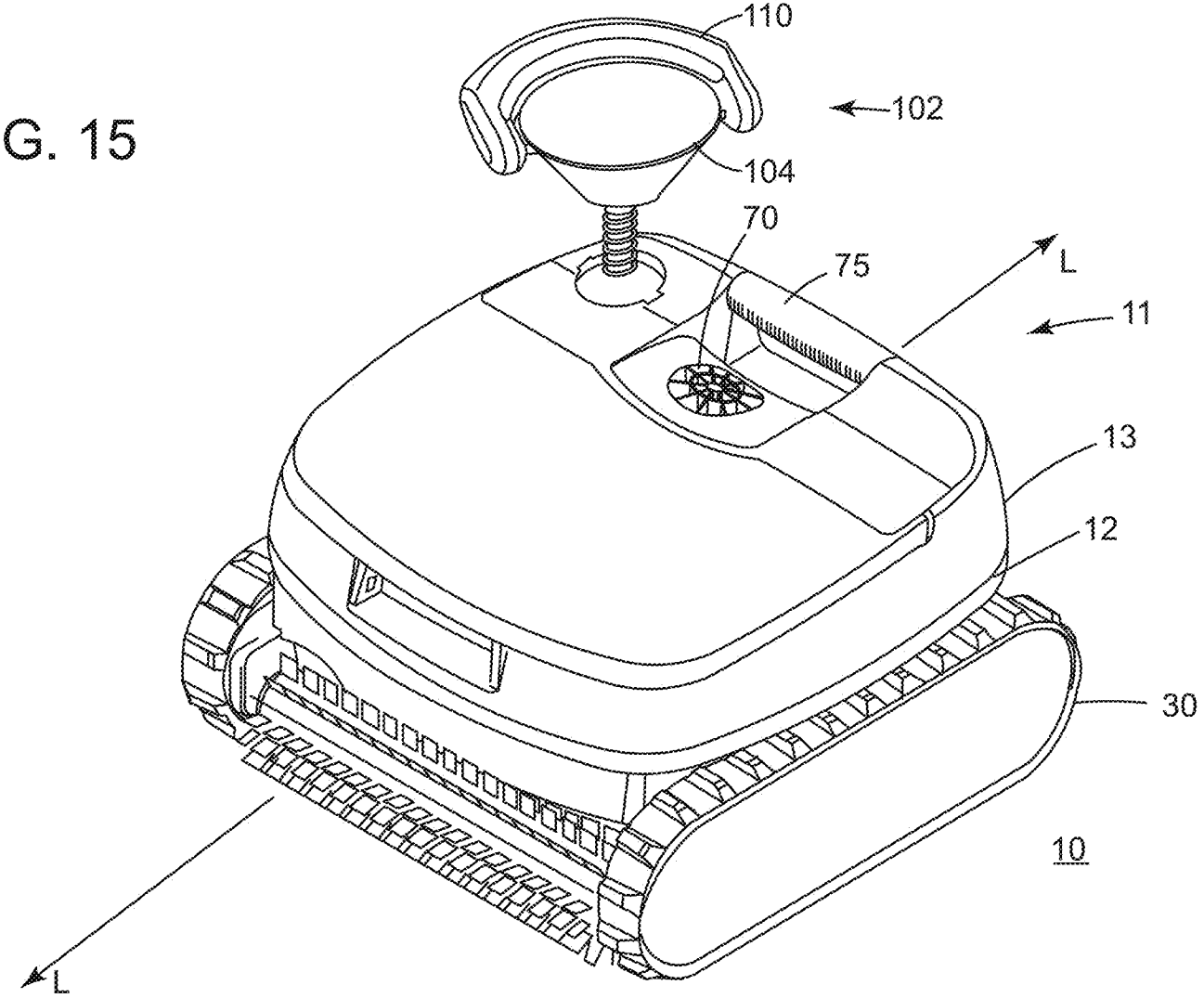
FIG. 15 is a top, front right side perspective view of a third embodiment of a self-propelled robotic pool cleaner having a buoy assembly tethered thereto for removing the cleaner.

Referring now to FIGS. 15 and 21, a second locking mechanism 108, e.g., preferably one or more sets of magnets 109 are provided to secure the buoy assembly 102 to the top portion of the cleaner 10 when the cable 106 is fully retracted. For example, a first of a pair of magnets 109 can be mounted on the lower portion of the buoy assembly 102 and a second of the pair of magnets 109 with opposite polarity is attached to the upper portion of the cable strain relief 119 or an opposing upper surface of the cleaner housing 11. The magnets 109 can be a pair of ring or toroidal shaped magnets, although such shapes and quantity of magnets is not considered limiting. When the cable 106 is reeled in, the magnets 109 will be magnetically attracted to each other when in close proximity and "lock" together to thereby prevent the unwinding or unspooling of the cable 106 and separation of the buoy housing 104 from the cleaner 10. The second magnetic locking mechanism 109 conveniently allows the end user to remove the cleaner 10 from the pool 130 as a single unit without any possible interference by the cable 106. Although the second locking mechanism 108 is described and shown as including a pair of magnets 109, such configuration is not considered limiting, as a latching mechanism or other locking mechanism can be implemented.

Referring to FIG. 22, the cleaner 10 is shown moving along the bottom surface 131 of the pool 130. The buoy assembly 102 is attached to the cleaner 10 via the cable 106, which can automatically adjust in length depending on the depth of the pool 130. In shallow water the spool 107 retracts the cable 106 to maintain a predetermined amount of slack in the cable line, while in deeper water the spool 107 releases additional cable line to continue to maintain the predetermined amount of slack in the cable line.

In one embodiment, the cleaner 10 is configured to communicate with a remotely located controller 120. Preferably, the communications between the remote controller 120 and the on-board controller 46 are facilitated by an RF receiver, and optionally a transmitter, which can be mounted, for example, in the interior chamber 14 of the cleaner housing 11 and/or the buoy assembly 102.

Figure 16:
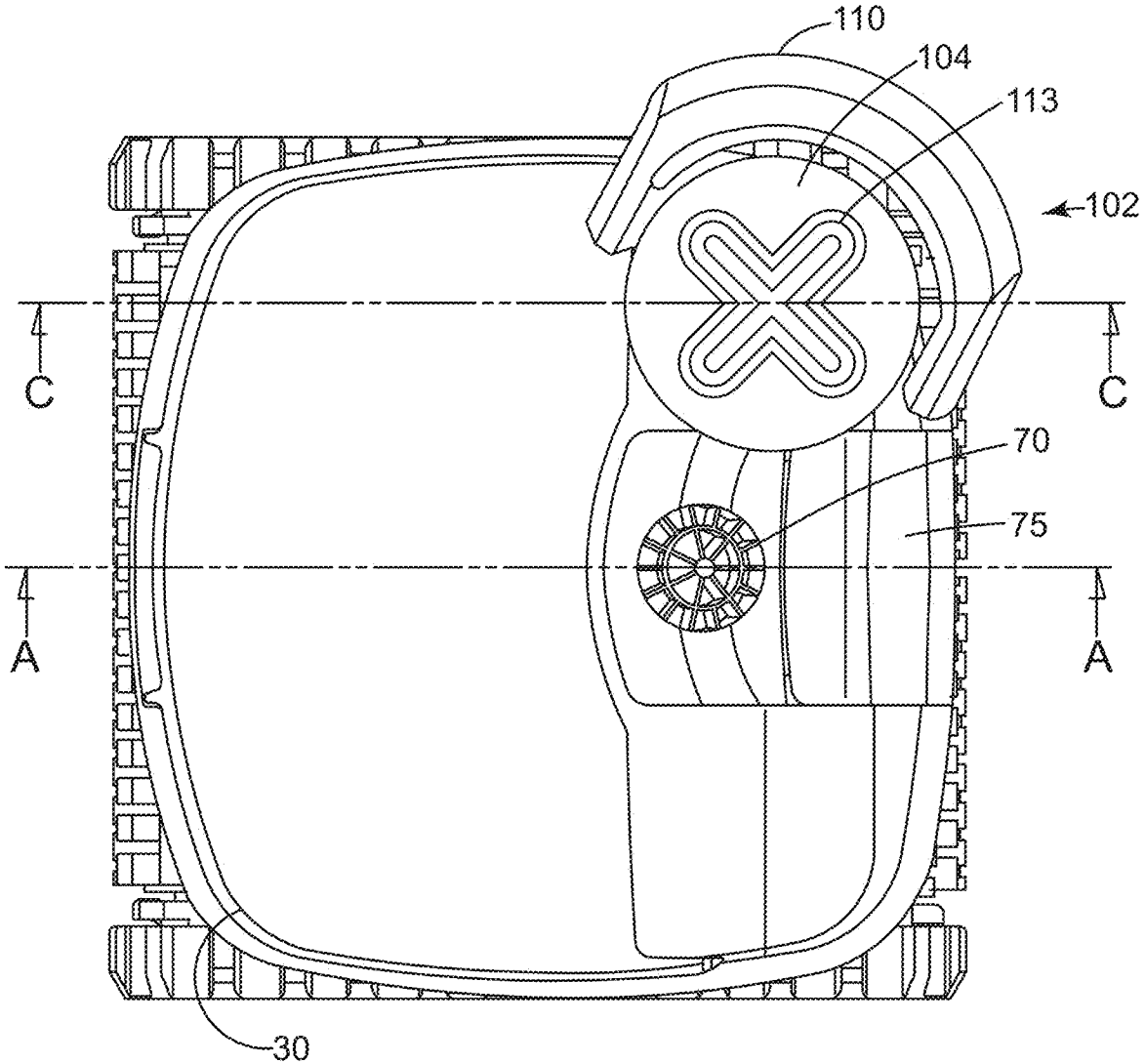
FIG. 16 is a top plan view of the pool cleaner of FIG. 15.
Figure 17:
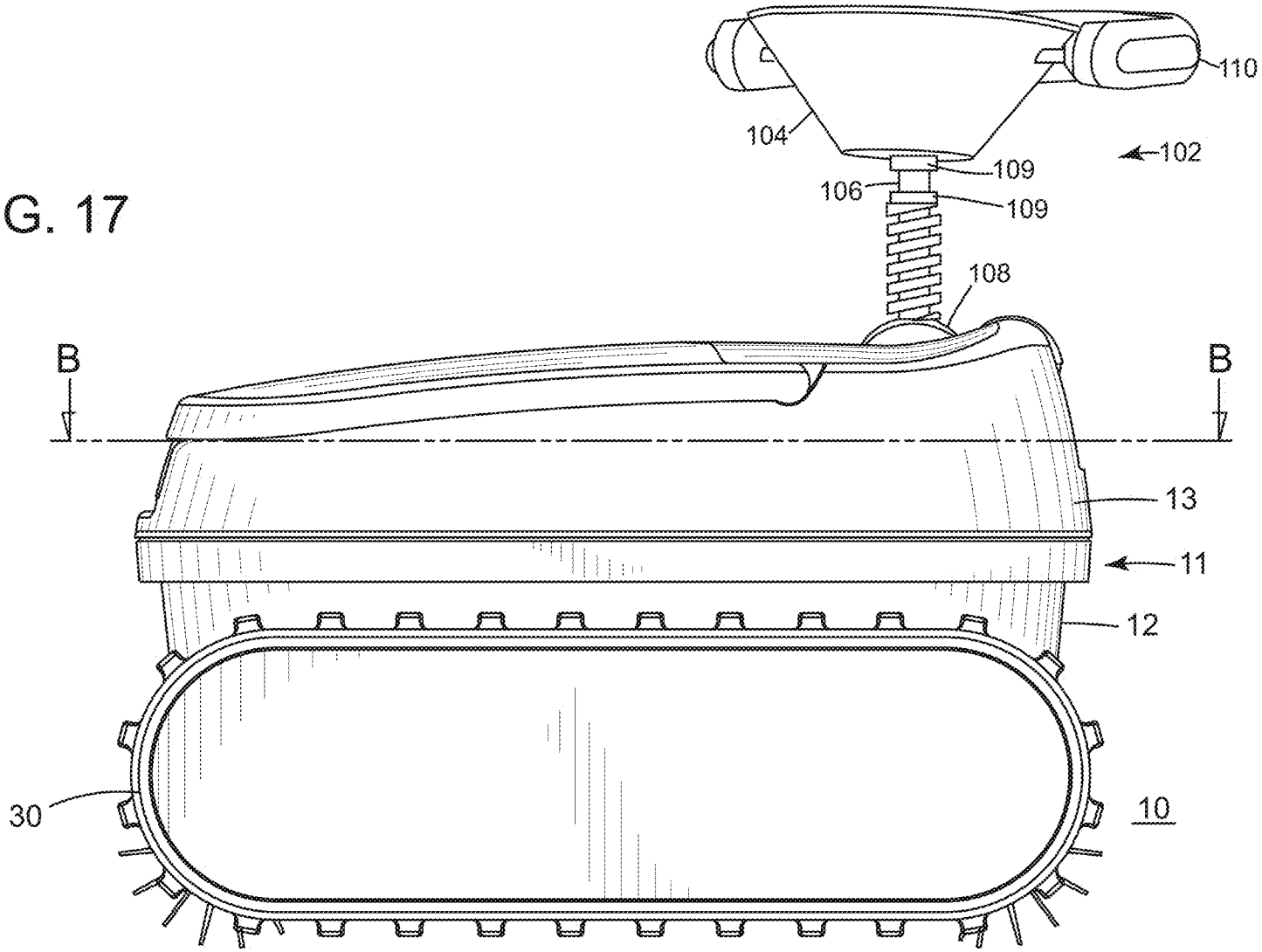
FIG. 17 is a right-side elevated view of the cleaner of FIG. 15.

Referring to FIG. 16, an antenna 113 is illustratively provided in the buoy assembly 102 and electrically connected to the cable 106. The cable 106 can be a single conductor wire having a water-impermeable covering that is preferably reinforced with a flexible wire cabling to provide added strength when lifting the cleaner 10 out of the pool 130 by the handle 110 of the receiver assembly 102. The antenna 113 receives (and transmits) wireless signals between the remote and on-board controllers 120 and 46.

Referring to FIGS. 19 and 20, a receiver or transceiver 124 is illustratively shown mounted in the interior chamber 14 of the cleaner 10 with the antenna 113 electrically connected to the receiver or transceiver 124 via the cable 106. Alternatively, the receiver or transceiver 124 can illustratively be housed in the spool 107 as shown in phantom in FIG. 21. The transceiver 124 includes well-known circuitry for amplifying and receiving/transmitting the wireless signals via the antenna 113 between the remote control device 120 and the on-board controller 46.

The on-board controller 46 and/or the remote controller 120 can include electronic circuitry and programming for controlling the operations of the cleaner 10 including steering the cleaner, e.g., providing power to the drive motors and the pump motors), as well as executing cleaning programs stored in memory for cleaning the submerged surfaces of the pool. Preferably, the on-board controller 46 is installed in the housing of the pump motor 81, although such location is not limiting.

During a cleaning operation, the cleaner 10 moves across the surfaces of the pool 130 to capture any debris in the water and expels the filtered water back into the pool, as described above with respect to the first and second embodiments of FIGS. 1-14. In the event a predetermined condition occurs, such as the cleaning pattern is completed, the filter is full, an overload current condition is sensed at the motor, a blockage, a low battery signal, the end-user decides to terminate the cleaning operation or some other predetermined condition, preferably the controller 46 will cause the cleaner 10 to move to a sidewall of the pool and cease the cleaning operation. In one embodiment where the cable 106 is not retracted but is locked to a fixed length, the end user can then grab the handle 110 of the buoy assembly 102 by hand or with an extension pole to pull up the locked cable 106 and raise the cleaner 10 to the waterline to a position where the cleaner 10 can be lifted out of the pool by its handle 75.

Alternatively, in an embodiment where the cable 106 does retract via the spring-loaded spool or an electric motor, the cleaner 10 will rise up to the floating buoy 102 so that the second locking mechanism 108 engages (e.g., the pair of magnets 109 are attracted to interface and "lock" with each other), and the end user can pull in and lift the cleaner 10 out of the pool by hand or with the aid of an extension pole. In yet another embodiment where the cable 106 retracts, the controller will cause the cleaner 10 to move to and climb the sidewall to the waterline of the pool 130 so that the second locking mechanism 108 engages, the end user can grasp the buoy handle 110 or cleaner handle 75 to lift the cleaner 10 out of the pool 130.

While the foregoing is directed to embodiments of the present invention, other and further embodiments and advantages of the invention can be envisioned by those of ordinary skill in the art based on this description without departing from the basic scope of the invention, which is to be determined by the claims that follow.

What is claimed is:

1. An apparatus for cleaning a surface of a pool comprising:

a submersible robotic pool cleaner having a housing including an upper portion disposed over a lower portion to define an interior chamber therein, the lower portion including a water inlet and the upper portion having a water discharge port;

rotatably-mounted supports supporting and guiding the submersible robotic pool cleaner along the pool surface;

a filter assembly for filtering water drawn through the water inlet;

a water pump assembly drawing water and debris from beneath the submersible robotic pool cleaner through the at least one inlet, the debris being retained by the filter assembly and the filtered water being discharged through the water discharge port during a cleaning operation;

a buoy assembly; and a retractable link connected to and extending between the submersible robotic pool cleaner and the buoy assembly, the retractable link (a) being selectively retractable by at least one of the submersible robotic pool cleaner and buoy assembly and (b) configured to be situated (i) in a first retracted position and, (ii) at least at times when the submersible robotic pool cleaner is submerged, in a second released position so that the buoy assembly floats to a pool water surface.

2. The apparatus of claim 1 further comprising a spool and a spool rotation mechanism to release and retract the link.

3. The apparatus of claim 2, wherein the spool and spool rotation mechanism are housed in the buoy assembly.

4. The apparatus of claim 2, wherein the spool and spool rotation mechanism are housed on-board the submersible robotic pool cleaner.

5. The apparatus of claim 2, wherein the spool rotation mechanism includes a spring.

6. The apparatus of claim 2, wherein the spool rotation mechanism includes an electric motor.

7. The apparatus of claim 2, wherein the spool is configured to adjust a length of the link as the buoy assembly floats on a pool water surface while the submersible robotic pool cleaner traverses at different depths of the pool.

8. The apparatus of claim 1, wherein the buoy assembly has a buoyancy sufficient to overcome a negative buoyancy of the submersible robotic pool cleaner and assist in lifting and raising the submersible robotic pool cleaner off a bottom surface of the pool by retracting the link.

9. The apparatus of claim 2, wherein the link is a cable and the buoy assembly includes a first locking mechanism to lock the spool and maintain a constant length of cable being extended.

10. The apparatus of claim 9, wherein the first locking mechanism comprises a latch and strike member arrangement.

11. The apparatus of claim 1, further comprising a locking mechanism for securing the buoy assembly to the upper portion of the submersible robotic pool cleaner.

12. The apparatus of claim 11, wherein the locking mechanism includes magnets.

13. The apparatus of claim 1, wherein the buoy assembly includes a handle.

14. The apparatus of claim 1, wherein the buoy assembly includes an antenna and the link is a cable that includes an electrical conductor for carrying received wireless signals from a remote controller to control circuitry in the submersible robotic pool cleaner.

15. The apparatus of claim 14, wherein the buoy assembly includes a receiver electrically coupled to the antenna and cable.

16. The apparatus of claim 14, wherein the submersible robotic pool cleaner includes a transceiver electrically coupled to the antenna via the cable.

* * * * *